United States Patent [19]

Thompson

[11] Patent Number: 4,681,302

[45] Date of Patent: Jul. 21, 1987

[54] ENERGY ABSORBING BARRIER

[76] Inventor: Marion L. Thompson, 53 Woodlyn La., Bradbury, Calif. 91010

[21] Appl. No.: 703,662

[22] Filed: Feb. 21, 1985

Related U.S. Application Data

[63] Continuation-in-part of Ser. No. 557,595, Dec. 2, 1983, abandoned.

[51] Int. Cl.[4] ..... E01F 15/00

[52] U.S. Cl. ..... 256/13.1; 256/19; 404/6

[58] Field of Search ..... 404/6, 7, 9; 52/2; 256/13.1, 1, 24, 19; 169/9

[56] References Cited

U.S. PATENT DOCUMENTS

| | | | |
|---|---|---|---|
| 1,049,261 | 12/1912 | Pelissier . | |
| 2,960,055 | 11/1960 | Tomek | 114/219 |
| 3,090,976 | 5/1963 | Liu | 9/8 |
| 3,141,655 | 7/1964 | Platt | 256/1 |
| 3,284,122 | 11/1966 | Rich | 293/1 |
| 3,503,600 | 3/1970 | Rich | 267/1 |
| 3,540,699 | 11/1970 | Guzzardella | 256/13.1 |
| 3,572,465 | 3/1971 | Olson | 256/13.1 |
| 3,661,359 | 5/1972 | Walker | 256/1 |
| 3,672,657 | 6/1972 | Young et al. | 267/116 |
| 3,856,268 | 12/1974 | Fitch | 256/13.1 |
| 4,138,095 | 2/1979 | Humphrey | 256/64 |
| 4,348,133 | 9/1982 | Trent et al. | 256/13.1 |
| 4,423,854 | 1/1984 | Cobb et al. | 256/13.1 |
| 4,435,106 | 3/1984 | Forster et al. | 256/13.1 X |
| 4,500,225 | 2/1985 | Quittner | 404/6 |

*Primary Examiner*—Cornelius J. Husar
*Assistant Examiner*—Joseph A. Fischetti
*Attorney, Agent, or Firm*—Fulwider, Patton Rieber, Lee & Utecht

[57] ABSTRACT

An energy absorbing barrier for dissipating kinetic energy upon impact by a moving vehicle. The barrier comprises walls defining a container closed except for a fill opening to admit water. Various configurations of side walls are disclosed. The side walls are resiliently deformable to return to their original shape after being struck, the resilience of the walls and their deformability tending to form a capture region adjacent the vehicle tire which tends to slow the tire and prevent it from climbing and vaulting the barrier. In one embodiment the walls include longitudinally extending, vertically spaced apart traction spoiler channels to reduce the area of contact between the barrier and the tires of a vehicle. Other embodiments include fittings for end coupling of a barrier to like barriers, the fittings permitting adjacent barriers to be located at different heights to accommodate gradual changes in terrain elevation. Other fittings are shown which enable arrangement of end coupled barriers in curvilinear and other configurations.

50 Claims, 60 Drawing Figures

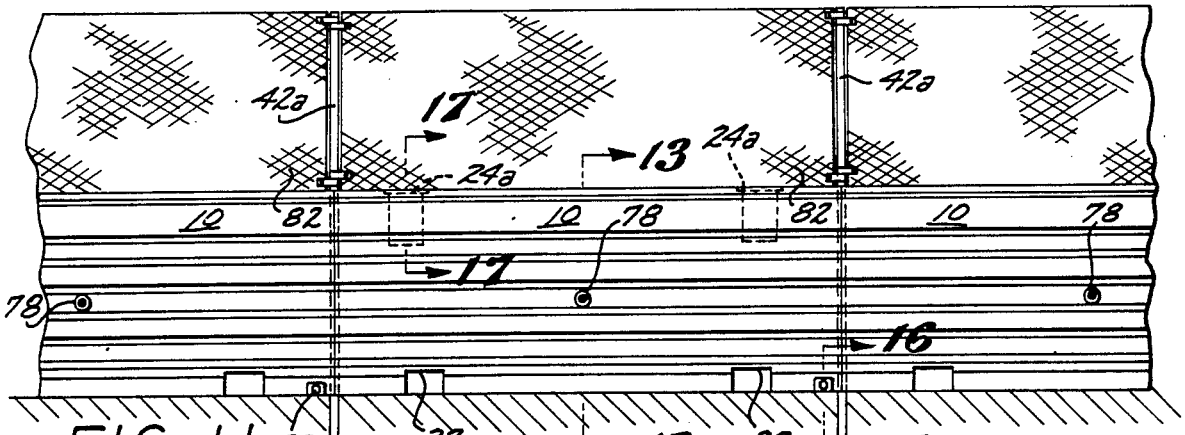
FIG. 11
FIG. 12
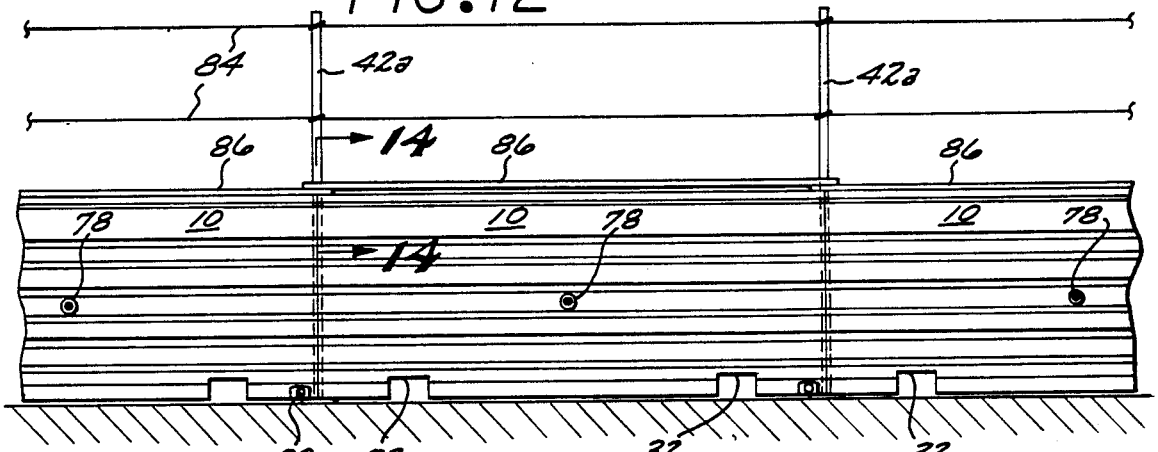
FIG. 13
FIG. 14
FIG. 17
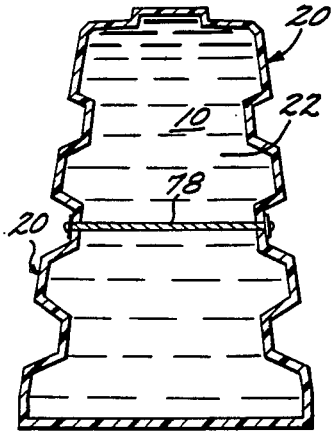
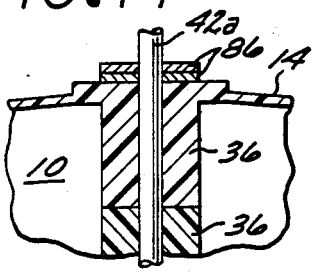
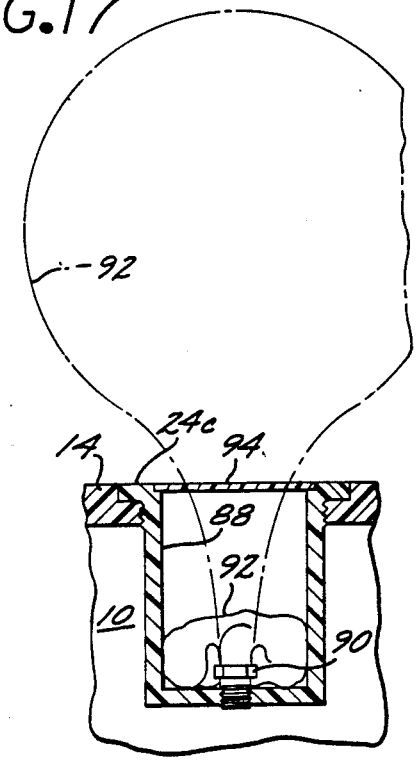
FIG. 15
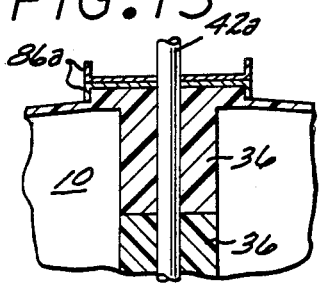
FIG. 16
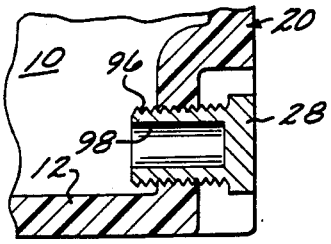

FIG. 37
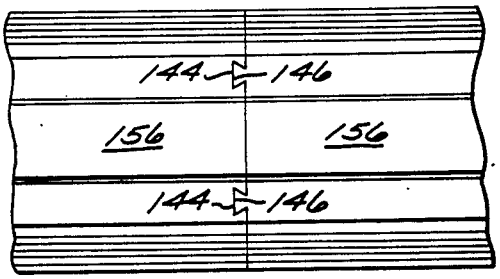
FIG. 36
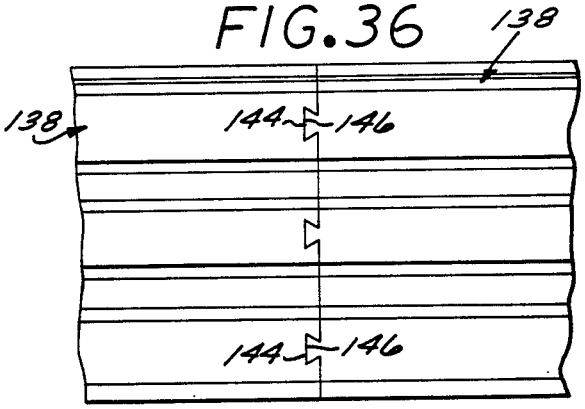
FIG. 38
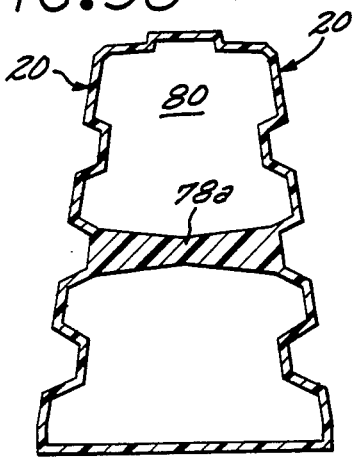
FIG. 39
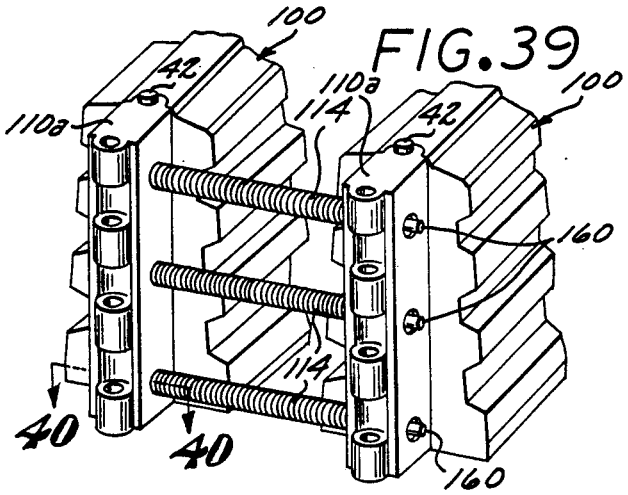
FIG. 40
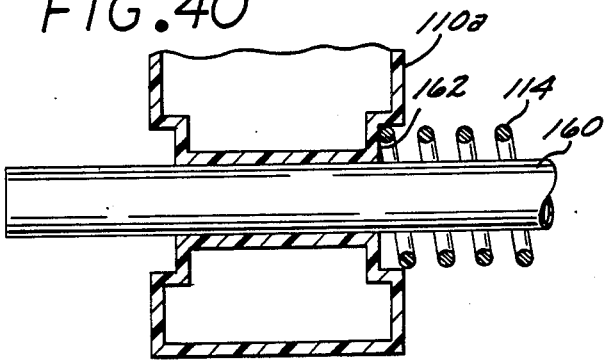
FIG. 41
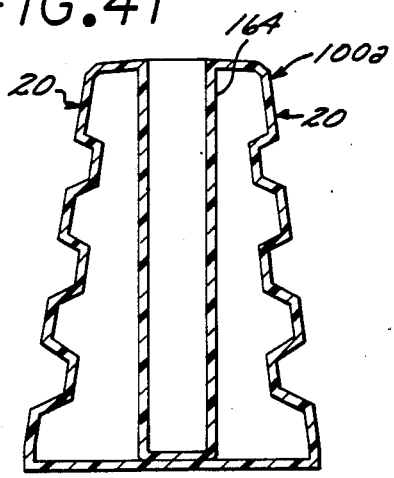
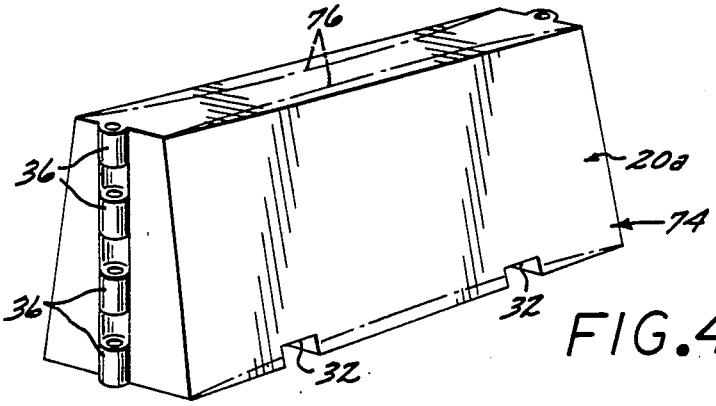
FIG. 42

FIG. 43
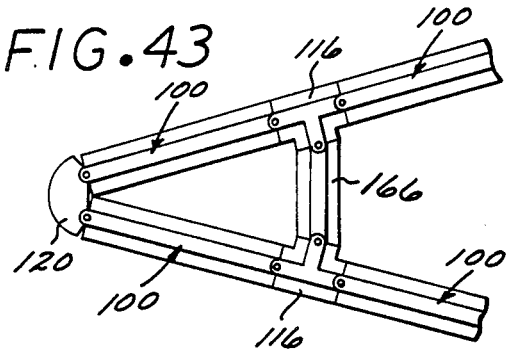
FIG. 44
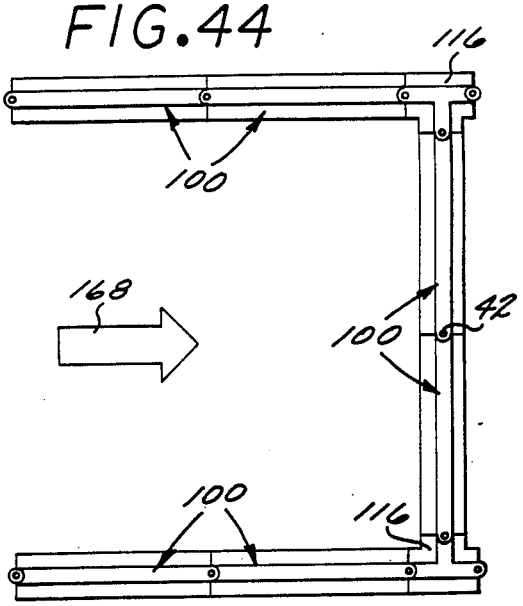
FIG. 45
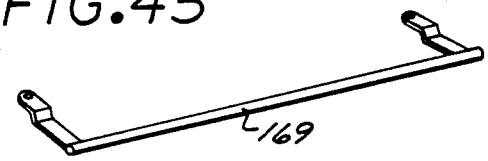
FIG. 46
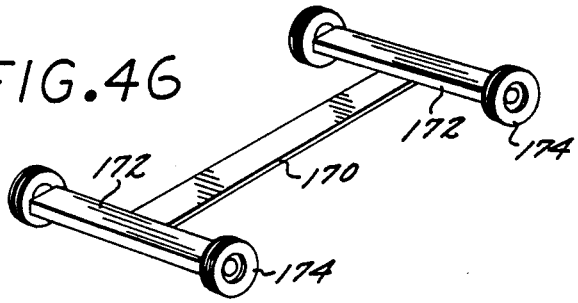
FIG. 47
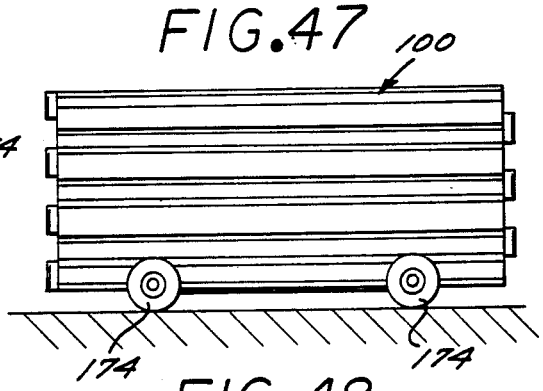
FIG. 48
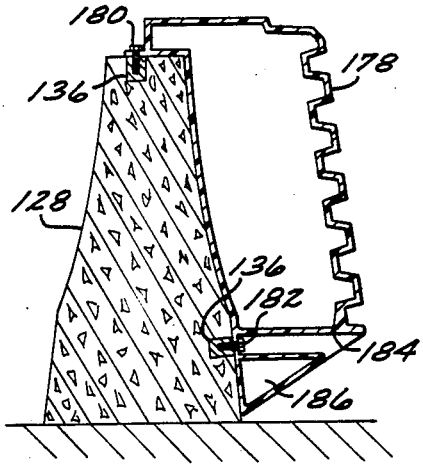
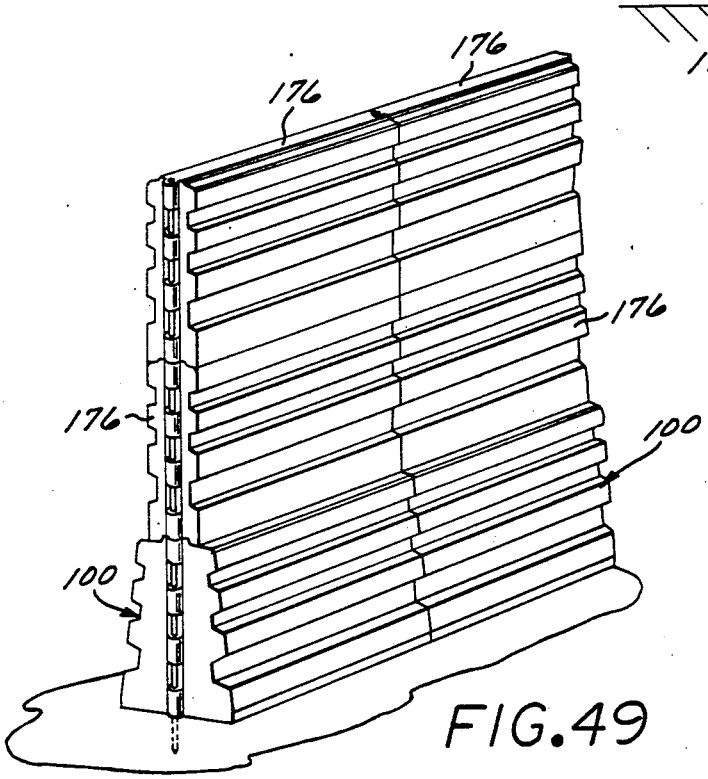
FIG. 49

ENERGY ABSORBING BARRIER

CROSS REFERENCE TO RELATED APPLICATION

This is a continuation-in-part of applicant's co-pending application Ser. No. 557,595, now abandoned filed Dec. 2, 1983, and entitled "Energy Absorbing Barrier".

BACKGROUND OF THE INVENTION

1. Field of the Invention

The present invention relates to an energy absorbing barrier, and more particularly to an energy absorbing barrier adapted for dissipating kinetic energy upon impact by a moving vehicle.

2. Description of Prior Art

Energy absorbing barriers are in common use for many vehicular traffic applications. Those of a semipermanent nature are heavy, difficult to install or are expensive to maintain. Barriers of this type include fixed guard rails, concrete median barriers, and special structures located in a protective array around highway signs, bridge abutments and the like. Lighter, more portable structures are less likely to absorb as much impact energy, but they are more easily installable for defining temporary traffic lanes, closing off highway construction sites, establishing pedestrian walkways, etc.

A typical highway barrier comprises elongated, blocks of concrete arranged end-to-end to intercept vehicles leaving a defined traffic lane. They physically redirect the path of the vehicle and can develop severe impact forces on the vehicle occupants. Further, the side walls of the barrier slope downwardly and outwardly to provide a relatively wide base to make the barrier difficult to overturn, but this also provides a climbing surface for the vehicle tires and a vehicle has a tendency to climb and vault the barrier and pass into oncoming traffic lanes or into other restricted areas.

Regardless of their shape or construction, most such barriers are made non-resilient, massive and heavy in order to positively stop vehicles. Of course, this is potentially very dangerous to the vehicle occupants. There are some barriers of the prior art designed to progressively absorb kinetic energy and thereby gradually decelerate a vehicle, but such barriers are typically relatively complex or expensive. Some are characterized by internal chambers filled with gas, liquids or other fluent materials. Others depend upon springs or internal shock absorbers. Regardless of their construction, such barriers are usually not readily adapted for interconnection to define a vehicle lane, or are characterized by side walls undesirably providing sufficient tire traction that vehicles can climb and vault such a barrier.

SUMMARY OF THE INVENTION

According to the present invention, an energy absorbing barrier is provided for dissipating kinetic energy upon impact by a moving vehicle. The barrier includes walls defining an interior chamber adapted to be filled with water. The unfilled barrier is relatively light and easy to transport to and from the place of use, while the filled barrier is sufficiently heavy to resist overturning on vehicle impact. The end walls include fittings for end coupling one barrier to another in a string to define a traffic lane, and also render the assembly virtually impossible to overturn.

The barrier side walls are made of a material having a relatively low coefficient of friction. The walls are resiliently deformable for resumption of their normal shape after being struck and deformed by a moving vehicle, and are characterized by a pattern of deformation which tends to trap and slow vehicle tires.

In a preferred embodiment the side walls include longitudinally extending, vertically spaced apart traction spoiler channels which reduce the area of potential contact for vehicle tires, and thereby reduce the tendency of a tire to climb the walls and vault a vehicle over the barrier.

The barrier internal chamber can be filled to a degree commensurate with the desired rate of energy dissipation. Moreover, the barrier can be internally pressurized to drive contained water or chemical liquids through a fire hose for fighting fires or the like, or to provide a protective water spray or fog around the driver of a crashed vehicle.

A simple closure cap is normally located over the filling opening of the barrier for pop off to release water on vehicle impact. The size of the opening can be selected to adjust the rate of water expulsion. The cap could be fixed in position if desired, in which case kinetic energy would be absorbed solely by deformation of the barrier and pressurization of any air in the barrier.

The fill opening could also be connected to an external diaphragm to accept expelled water and return it for reuse.

Couplers can be used to interconnect the end walls of adjacent barriers. The end faces of the couplers are located at various included angles to orient the barriers along predetermined paths to provide a curvilinear barrier assembly, or a serpentine or zigzag array, or a "stacked", relatively compact barrier assembly having great mass for dissipating very high impact forces.

The end fittings and couplers are characterized by sufficient clearances or tolerances to allow adjustment of the height or inclination of adjacent barriers to accommodate slight changes in terrain.

The barrier may be provided with fencing or similar supplemental structures to define a higher barrier, it can be provided with transverse or elongated reinforcing elements for reinforcement against undue flexure, and it can be provided with auxiliary bias means such as springs to further assist in absorbing vehicle impact and the like.

Certain embodiments of the barrier are configured to mount on one or both sides of usual median barriers. This provides supplemental vehicle impact protection, rather than providing a substitute for the existing median barriers.

Other objects and features of the invention will become apparent from consideration of the following description taken in connection with the accompanying drawings.

BRIEF DESCRIPTION OF THE DRAWINGS

FIG. 10 is a view similar to FIG. 9, but illustrating a barrier fitted with a means for using the contained liquid for fire fighting or the like;

FIG. 11 is a side elevational view of end coupled barriers provided with expanded metal screening surmounting the liquid fillable portion of the structure;

FIG. 12 is a view similar to FIG. 11, but illustrating utilization of poles and interconnecting barrier wires instead of metal screening;

FIG. 13 is an enlarged cross-sectional view taken along the line 13—13 of FIG. 11;

FIG. 14 is an enlarged view taken along the line 14—14 of FIG. 12;

FIG. 15 is a view similar to FIG. 14, but illustrating an I-beam form of longitudinal connector, rather than the strap connector illustrated in FIG. 14;

FIG. 16 is an enlarged view taken along the lines 16—16 of FIG. 11, and particularly illustrating employment of a metal drain plug in the plastic material of the barrier;

FIG. 17 illustrates a form of filler cap adapted to store a collapsible bag which is outwardly deployable by liquid driven from the barrier;

FIG. 36 is a view taken along the line 36—36 of FIG. 34;

FIG. 37 is a view taken along the line 37—37 of FIG. 37—37 of FIG. 35;

FIG. 38 is a view similar to FIG. 13, but illustrating an integrally molded reinforcement of the barrier which serves as a substitute for the cable of FIG. 13;

FIG. 39 is a perspective view of the ends of a pair of laterally spaced apart barriers, such as those shown in FIG. 23, but showing another form of end connector or coupling;

FIG. 40 is an enlarged view taken along the line 40—40 of FIG. 39;

FIG. 41 is a view similar to FIG. 13, but illustrating another embodiment of the barrier, and which is characterized by a vertically extending central core fillable with concrete, earth or the like;

FIG. 42 is a perspective view of yet another embodiment of the present barrier, the barrier of FIG. 42 being characterized by sloping sides absent the traction spoiler channels seen in the embodiment of FIG. 1;

FIG. 43 is a view similar to FIG. 27, but illustrating employment of the T-fitting of FIG. 25;

FIG. 44 is a view similar to that of FIG. 25, but illustrating end connected barriers spaced apart and connected together by end connected transverse barriers;

FIG. 45 is a perspective view of a hanger bracket for attachment to a barrier for suspending a protective covering or sign or the like adjacent the barrier side;

FIG. 46 is a perspective view of a typical dolly for transporting a barrier, as shown in side elevation in FIG. 47;

FIG. 48 is a view similar to FIG. 34, but utilizing a different form of half barrier not requiring the support pedestal of the embodiment of FIG. 34;

FIG. 49 is a perspective view similar to FIG. 1, but employing superjacent upper barriers surmounting the main or lower barriers;

DESCRIPTION OF THE PREFERRED EMBODIMENTS

Figure 1:
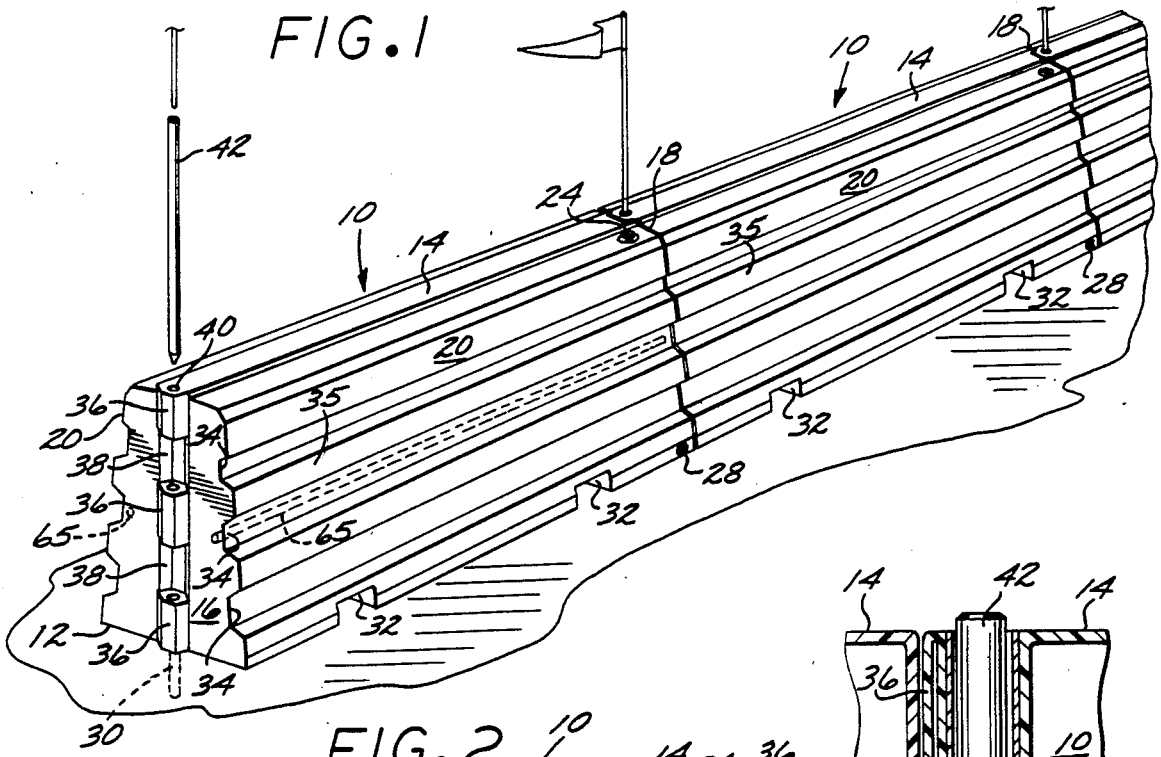
FIG. 1 is a perspective view of an energy absorbing barrier according to the present invention, the barrier being illustrated as connected at one end to a like barrier to define a race course.
Figure 3:
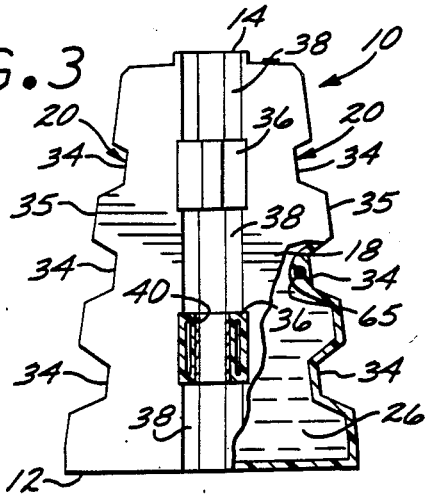
FIG. 3 is a view taken along the line 3—3 of FIG. 2.

Referring now to the drawings, and particularly to FIG. 1, there is illustrated a barrier 10 according to the present invention and comprising, generally, an elongate container having a flat base 12, a top 14, a pair of end walls 16 and 18, and a pair of side walls 20 defining an interior chamber 22, as best seen in the cutaway showing in FIG. 3.

The barrier container includes a fill opening which is normally closed by a bung or cap 24, as generally indicated in FIG. 1. Ballast such as water 26 or other fluent material can be admitted through the fill opening to partially or completely fill the interior chamber 22, as will be seen. Suitable drain openings closed by threaded plugs 28 or the like are located at the bottom of the chamber 22 adjacent the base 12.

The base 12 is adapted to be placed upon any suitable supporting surface such as the ground or pavement. It can be fixed to the ground, as will be seen, or fixed to a structure embedded in pavement, such as to the cylindrical receptacle shown in dotted outline at 30 in FIG. 1.

The barrier 10 is widest at its base 12, and the side walls 20 slope upwardly and inwardly to form a generally horizontally oriented and narrow top 14.

The barrier 10 is preferably molded of a plastic material characterized by high strength, resilience, and resistance to permanent deformation, such as a cross-linked, high density polyethylene material. A very important characteristic of this plastic material is its low coefficient of friction or slipperiness, as will be seen. A suitable material for the barrier 10 is available under the trademark MARLEX CL-100 from Phillips Chemical Company of Bartlesville, Ok. It provides high impact resistance at cold temperatures, excellent tensile strength, and resistance to weathering because of included antioxidants and ultraviolet stabilizers.

The material is characterized by a relatively low coefficient of friction and good flexure. Consequently, in wall thicknesses such as are preferably used in the barrier 10 and its variants, a tire will typically deform the barrier and slide along its length, developing a bulge or traveling wave of side wall material which tends to trap, capture and slow the vehicle tire. This phenomenon permits more gradual slowing of the vehicle, while the slippery quality of the barrier side wall tends to prevent the tire from climbing out of its captured state. As will be seen, various barrier side wall configurations are hereinafter set forth to best capitalize on this characteristic.

A barrier made of such material is relatively light in weight, an empty or unfilled barrier 10 approximately 33 inches high, 60 inches long, and measuring 24 inches at the base, weighing approximately 100 pounds. Two men can easily lift such a barrier and arrange a number of the barriers in end-to-end relation to form pedestrian lanes at movies, amusement parks, or wherever people must line up for some purpose.

A barrier of the above dimensions completely filled with water weighs approximately 1250 pounds. This weight, plus the truncated configuration of certain embodiments of the barrier, makes it very difficult to overturn.

Figure 2:
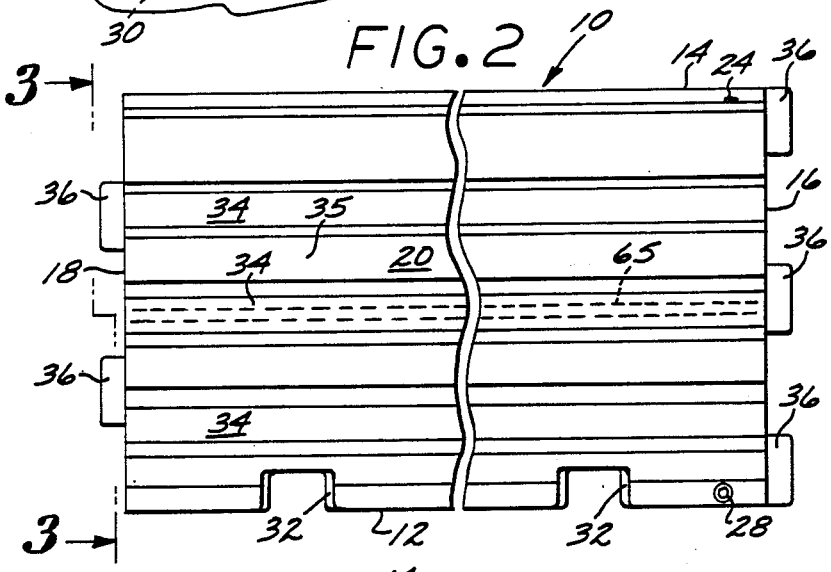
FIG. 2 is a side elevational view of the barrier of FIG. 1.

The barrier is transportable by a forklift or the like, the lift fork being receivable within recesses 32 molded into the base 12, as best seen in FIGS. 1 and 2.

The energy absorption properties of the barrier 10 is adjustable varying the materials of which it is made, or by varying its configuration or dimensions, including its wall thicknesses. Such properties are also affected by the type of fluid filling material, and the degree of filling, that is, the proportion of liquid to air. A barrier partially filled with water includes a relatively large air space within which the water may flow on impact, and the air acts in the manner of a gas accumulator. A completely filled barrier is relatively incompressible except through liquid escape through the fill opening, and deformation of the barrier structure.

The dimensions of the fill opening can be arranged to provide a relatively rapid escape of water, or a metering arrangement can be provided to more gradually dissipate impact kinetic energy, as will be apparent. The manner of empirically adjusting these factors to provide a desired rate of energy dissipation will be immediately apparent to those skilled in the art and a discussion thereof is omitted for brevity.

Figure 10:
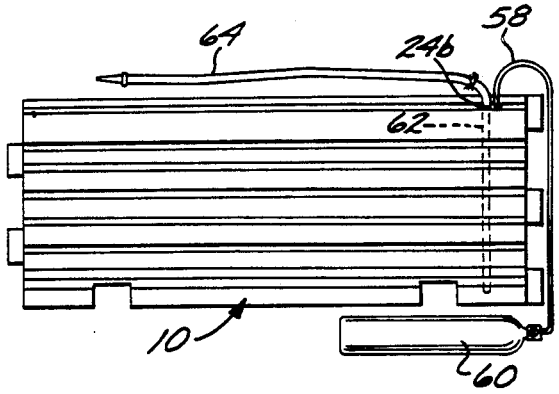

The relative resilience of the FIG. 10 barrier is important. It must retain its shape when filled, it must be resilient enough to resume its shape after it has been deformed by a moving vehicle or the like, and it should be resilient enough to form a deformation bulge ahead of an impacting vehicle tire to slow its progress and prevent it from climbing the barrier.

An important feature of the side walls 20 of the embodiment of FIG. 1 is the inclusion of integral or molded-in traction spoiler channels 34. The longitudinally extending channels 34 extend are vertically spaced apart to reduce the area of potential contact between the side walls 20 and the tire of the vehicle. For example, assuming a typical 30 inch diameter vehicle tire, and the 33 inch high barrier 10 above described, a tire will hit a rib 35 defined between the pair of uppermost channels 34. This rib 35 has a small surface area compared to the tire tread area presented by the sloping flat side walls of prior art concrete barriers. In the barrier 10 the area of tire traction is only that presented by the ribs remaining after formation of the recessed channels 34. As a consequence, it is much less likely that a tire will climb up a side wall 20 and vault the vehicle over the barrier.

Figure 50:
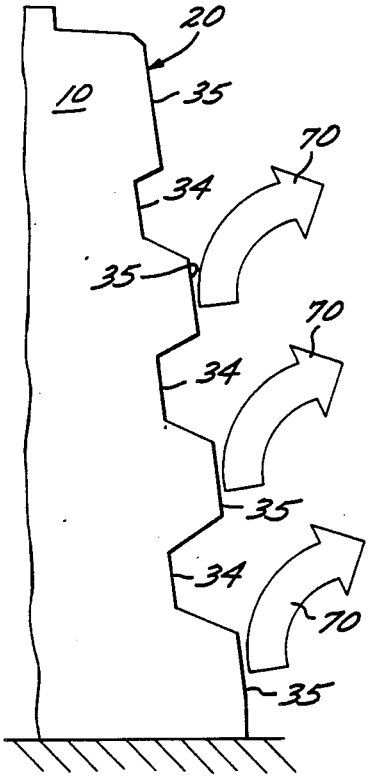
FIG. 50 is an end elevational view of the barrier of FIG. 1, diagrammatically illustrating the successive losses of traction by a vehicle tire as it encounters the vertically spaced apart traction spoiler channels.
Figure 51:
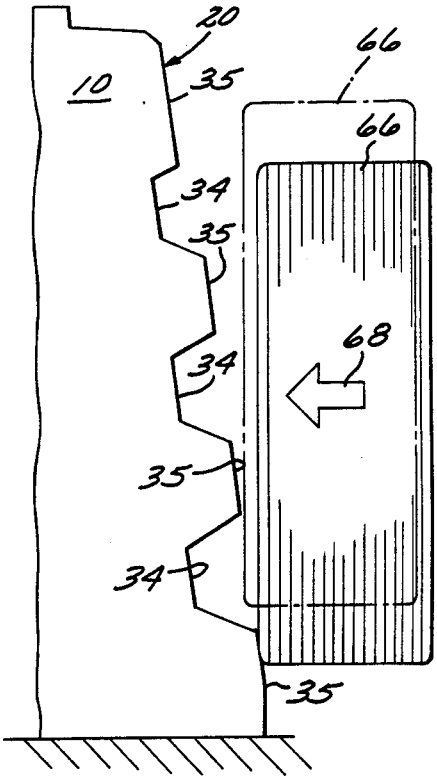
FIG. 51 is a view similar to FIG. 50, illustrating a vehicle tire in full line and phantom line positions, the phantom position illustrating the loss of traction at the lowermost traction spoilerichannel.

The deformability and low coefficient of friction of the material of the barrier 10 are surprisingly effective in resisting the tendency of a vehicle tire 66 to climb and vault the barrier 10. More specifically, as seen in FIGS. 50 and 51, the lateral component of movement of the vehicle tire 66 is shown by the arrow 68. The lower inward periphery of the tire 66 is seen to initially engage the lowermost rib 35, thereafter climbing upwardly from the full line position to the phantom line position.

Upon attaining the phantom line position, the tire suffers an immediate loss of traction in the area of the lowermost traction spoiler channel 34. This loss of traction, and consequent resistance to further upward climbing, is denoted in FIG. 50 by the curved arrow 70. As the lower edge periphery of the tire 66 engages or comes into alignment with successive channels 34, the successive losses of traction are represented by the other arrows 70.

It has been found that the loss of traction provided by the spoiler channels, coupled with the slipperiness of the barrier material, substantially prevents undesirable climbing and vaulting of the barrier 10.

As previously mentioned, there is another characteristic of the barrier 10 which further acts to slow the travel of a vehicle tire 66 and prevent it from vaulting the barrier 10. This characteristic is present regardless of the configuration of the barrier side wall.

Figure 52:
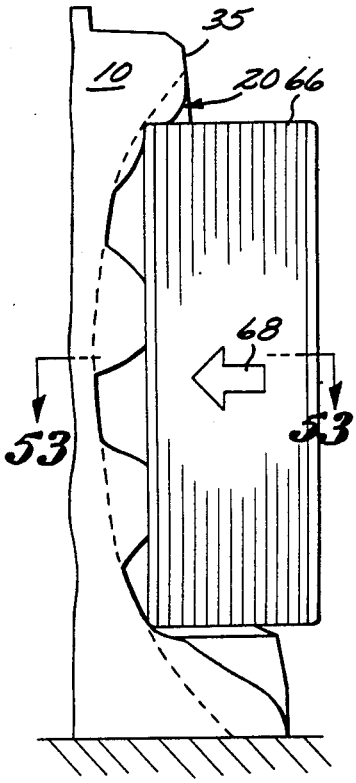
FIG. 52 is a view similar to FIG. 51, illustrating deformation of the barrier of FIG. 1 by an essentially laterally travelling vehicle tire.

More particularly, FIG. 52 schematically shows the dynamics of a tire 66 striking the barrier 10 at a relatively shallow angle of convergence, but with severe force so that it penetrates rather deeply into the barrier. The material of the barrier 10 deforms to absorb the impact energy developed by the tire 66, but the deformation is such that the upper portion of the barrier 10, particularly including the uppermost rib 35, defines an overhang which tends to entrap or capture the tire to prevent it from climbing. The low coefficient of friction of the material of the barrier also aids in this respect, providing scrubbing or slowing engagement with the tire to slow its forward movement.

Figure 53:
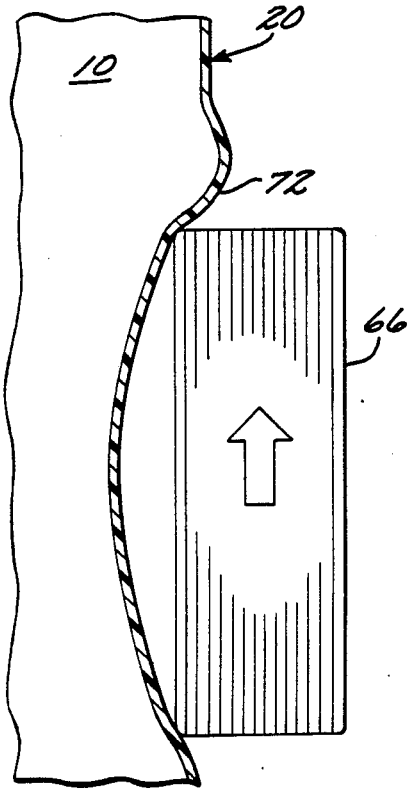
FIG. 53 is an enlarged view taken along the line 53—53 of FIG. 52.

As seen in FIG. 53, there is also a dynamically formed traveling wave or bulge 72 located in advance of the vehicle tire 66. This is caused by deformation of the resilient material of the barrier 10 and it tends to move in advance of the leading portion of the tire 66, scrubbing against it and slowing its forward progress.

Figure 54:
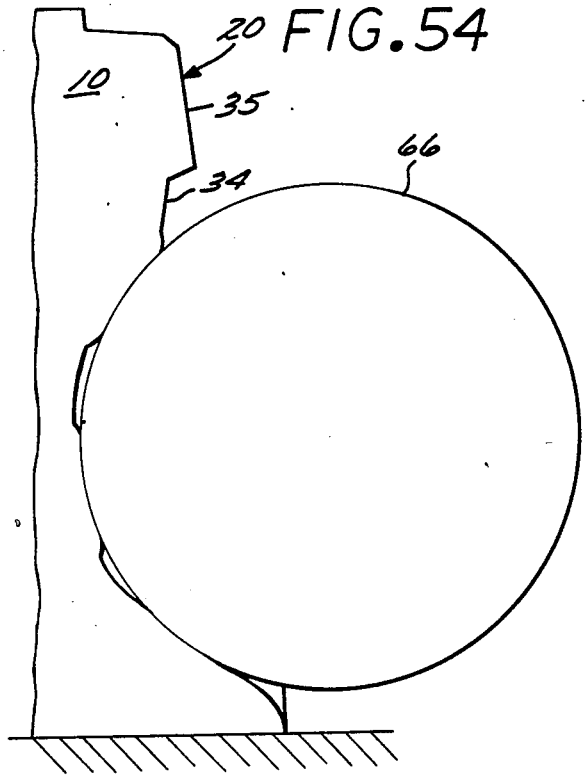
FIG. 54 is a view similar to FIG. 52, and illustrating the manner of deformation of the barrier of FIG. 1 by a vehicle tire travelling approximately at a right angle to the barrier side.

The barrier resilience and low coefficient of friction are also important in a situation where the vehicle tire 66 is travelling at substantially a right angle to the barrier 10. In this eventuality, as seen in FIG. 54, the barrier side wall deforms in somewhat the same manner as described in connection with FIG. 52, but to a much greater extent. Consequently, the undeformed upper rib 35 overlies more of the tire. Again, the low coefficient of friction of the material of the barrier 10 acts to reduce the tendency of the tire 66 to climb upwardly upon the barrier side wall 35.

Although the channel 34 and rib 35 configuration of the barrier 10 of FIG. 1 is preferred because of the tire traction losses described in connection with the showing of FIG. 50, in certain applications the deformation capability and low coefficient of friction of material of the barrier are sufficient for certain barrier applications. Such a modified configuration is illustrated in FIG. 42. The modified barrier 74 is like the barrier 10 in all respects except that it is characterized by, generally planar upwardly and inwardly sloping side walls 20*a*. The walls 20*a* deform in the manner shown in FIGS. 52 and 53.

A lower case letter, such as the "a" in 20*a* is used throughout this specification to denote structures which are essentially the same in function but not in construction.

The modified configuration of FIG. 42 also includes, as shown in phantom outline at 76, a concave molded-in configuration which tends to provide a straight wall when the barrier is filled. Water or other filling material tends to bulge or outwardly deform the barrier side walls. By starting with a molded-in concave shape, outward bulging of the sides of the filled barrier is avoided.

Further resistance to outward bulging can be provided by molding a cable 65 into the material of the barrier, as seen in FIGS. 1–3. One such cable 65 is located in each barrier side wall approximately half way between the top 14 and base 12. Although each cable 65 is tensioned to resist outward bulging, it can move inwardly or outwardly on deformation of the barrier 10 by an impacting vehicle.

FIG. 13 illustrates another arrangement to provide side wall resistance to outward bulging. In this embodiment one or more transverse cables 78 are connected between the side walls 20, each being collapsible on inward deformation of a side wall 20.

FIG. 38 is yet another embodiment to eliminate side wall bulging. A modified barrier 80 includes an integral, molded-in, transversely disposed wall or web 78*a* which extends between the opposite barrier side walls. The web 78*a* may be made continuous along the length of the barrier 80 or it can be molded in discontinuous sections at longitudinally spaced intervals. It is preferably flexible or resilient so that it can collapse upon vehicle impact against the barrier.

The energy dissipation properties of the barrier 10 can be further modified by end coupling a plurality of barriers. Depending upon how the barriers are oriented, the assembled barriers are adapted to define a straight or curvilinear traffic lane, a race course, a median barrier, or stacked barrier for absorbing relatively high velocity impact forces.

Figure 4:
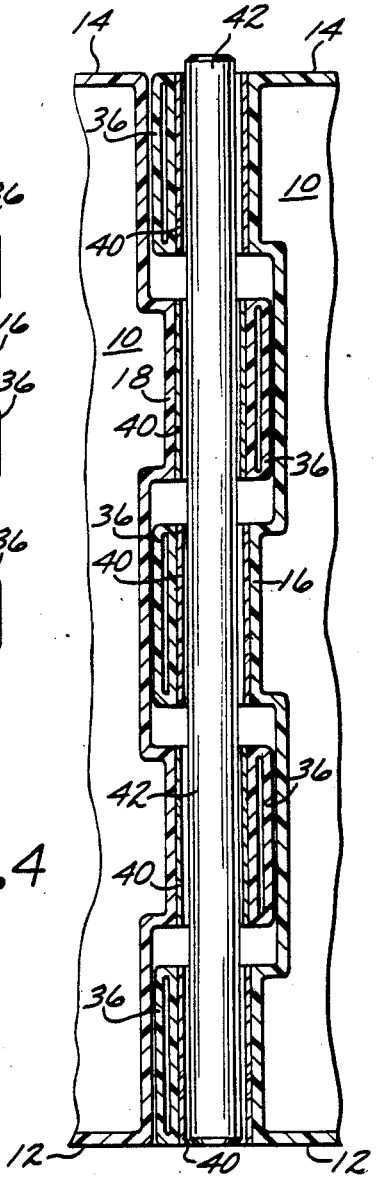
FIG. 4 is a detail longitudinal cross-sectional view of the pin coupled portions of adjacent barriers.

Although various means may be visualized for end coupling the barriers, one suitable arrangement comprises the hinge pin assembly seen in FIG. 1. The end wall 16 includes three vertically aligned, integrally molded knuckles or protuberances 36 separated by intervening recesses 38. The opposite end wall 18, as best seen in FIGS. 2 and 4, includes two protuberances 36 and three recesses 38, the two protuberances being adapted to fit within the pair of recesses 38 of the end wall 16 of an adjacent barrier 10.

A section of aluminum tubing or the like is integrally molded or press fitted within a suitable vertical opening in each of the protuberances 36 to form pin bushings 40. The bushings 40 are vertically aligned to receive a pipe or connecting pin 42.

If desired, each pin 42 can be made long enough to extend down into a receptacle 30 which is located in the underlying pavement or ground, or it can be driven into the ground or other supporting surface.

Flag poles 44 can be inserted into the upper open ends of each pin 42, as seen in FIG. 1, to better identify the location of a race course, for example. Alternatively, longer pins 42*a*, as seen in FIGS. 11 and 12, can be employed, the portions projecting above the barrier tops 14 providing supports for shielding or protective fencing 82 to provide a visual barrier, to isolate people from a restricted area, to offer protection against vehicle parts or debris flying across the tops of the barriers 10, or to add additional protection against vaulting or ramping of vehicles over the barriers.

Instead of the fencing 82 illustrated in FIG. 11, longitudinally disposed cables 84 can be employed to further protect against vaulting or ramping vehicles, the cables 84 being strung between and connected to the upwardly projecting portions of the rods or pins 42*a*, as seen in FIG. 12.

FIGS. 11, 12, 14 and 15 illustrate other optional features which can be employed with the barriers 10. Thus, a plurality of elongated bars or straps 86 overlie respective barriers 10, the bars 86 being long enough so that their ends overlap. In addition, the bar ends are provided with apertures for receiving the pins 42*a* to integrally fix the bars 86 in position on top of the barrier tops 14. The bars 86 bear a portion of the impact forces developed upon the hinge knuckles or protuberances 36 by the pins 42*a* upon vehicle impact. By reason of this function, the bars 86 substantially prevent any structural failure of the protuberances 36 which might otherwise occur when the pins 42*a* act upon the protuberances 36. For additional strength the straps 86 can be made in channel form 86*a*, as illustrated in FIG. 15, the channel shape providing even more resistance to longitudinal bending.

FIGS. 11 and 12 also illustrate a modified form of filler cap 24*c*, as best seen in FIG. 17. The cap 24*c* is characterized by an upwardly open cylindrical body 88 which is threadably associated at its upper extremity with the barrier top 14. The hollow interior of the body 88 includes a normally open vent plug 90 in its base. A flexible container or bag 92 is carried or housed within the body 88 and is fluid coupled to the vent plug 90. With this arrangement, water expulsion from the barrier 10 upon vehicle impact will pass through the plug 90, fill the bag 92 and thrust it upwardly and outwardly of the barrier top by popping off a disk 94 which normally overlies and closes the hollow interior of the body 88. The bag 92 is preferably made of resilient material so that it will force the expelled fluid back into the barrier 10 subsequent to vehicle impact.

FIG. 16 illustrates another feature of the barrier 10 of FIGS. 11 and 12. More particularly, the drain 28 is characterized by a threaded shank 96 provided with a blind bore 98. If after long service the drain 28 cannot be removed, the bore 98 can be threaded to receive a replacement plug.

Figure 8:
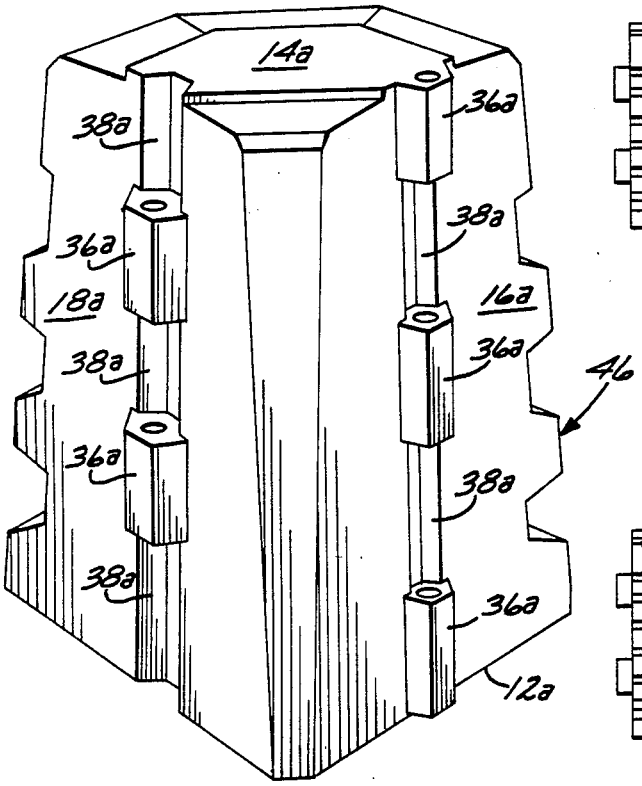
FIG. 8 is a perspective view of a typical coupler.

End connected barriers 10 are preferably relatively movable to a certain extent to conform to uneven terrain. For this purpose a predetermined, relatively generous clearance is provided between the adjacent horizontal surfaces of the interconnected protuberances 36, between the protuberances 36 and the adjacent vertical walls of the recesses 38, between the surfaces of the adjacent end walls 16 and 18 of the end coupled barriers 10, and also between the pin 42 and the bushings 40. Such clearances enable the barriers to be arranged slightly out of longitudinal alignment to define a gradual curve of relatively great radius, or to fit closer together at their bottoms than at their tops for gentle terrain rises, or to be vertically offset to also accommodate terrain unevenness.

Where it is desired to arrange the barriers in a more pronounced change of direction, that is, one of short radius, the specially configured coupler 48 of FIG. can be used. The coupler 48 is preferably an empty, easily movable hollow body molded of the same material as the barrier 10, although it could also be made for filling, as will be apparent. Its end faces or walls correspond to the barrier end walls and are characterized by a complemental configuration and arrangement of protuberances and recesses. Lower case letters are employed in FIG. 8 to show this correspondence.

Figure 5:
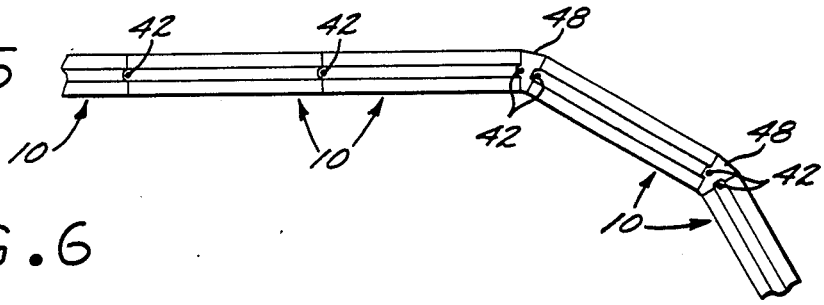
FIG. 5 is a partially diagrammatic top plan view of barriers connected by couplers to form one side of a race course turn.

The coupler 48 can be made with its end faces or walls 16*a* and 18*a* defining any desired included angle. In FIG. 5 the end faces are arranged at an angle of approximately 30 degrees, the single coupler 48 being connected between the ends of adjacent barriers 10 by a connecting pin 42. The resultant curve has a radius of approximately 52 feet.

Figure 6:
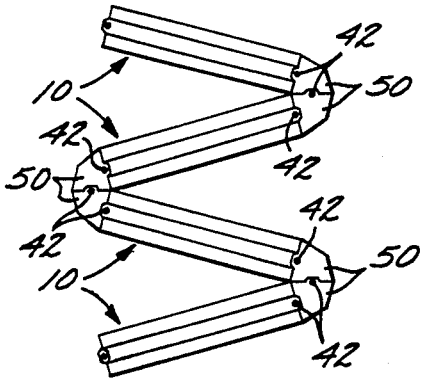
FIG. 6 is a view similar to FIG. 5, but illustrating use of differently configured couplers to orient the barriers in a generally serpentine, zigzag configuration.

FIG. 6 illustrates yet another form of coupler, the end faces of the pair of couplers 50 defining an included angle of somewhat less than 90 degrees. Each pair of couplers 50 are connected to each other and to the ends of adjacent barriers 10 by three pins 42. This orients the connected barriers in a serpentine, zigzag or loosely stacked arrangement such that impacting vehicles are gradually decelerated by successive collapsing or closing movement of the barriers against each other. Assuming the vehicle is approaching from the top, as seen by the viewer in FIG. 6, the first barrier 10 would absorb a portion of the kinetic energy, swing toward the second barrier 10, that barrier would further dissipate kinetic energy, and so on as the stack collapses to a closed configuration.

Figure 7:
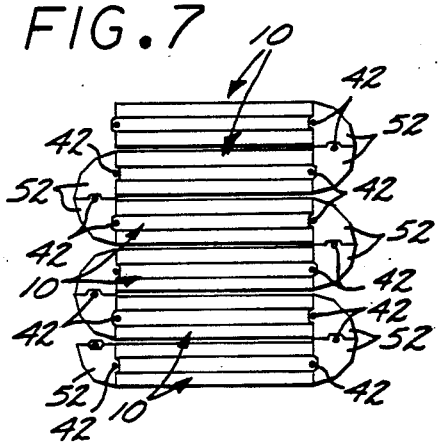
FIG. 7 is a view similar to FIG. 6, but illustrating use of yet another configuration of coupler to orient the barriers in adjacent, "stacked" relation.

FIG. 7 illustrates an arrangement of connected barriers and couplers 52 in which the coupler end faces define an included angle of approximately 90 degrees, a pair of couplers 52 being used between the ends of each pair of adjacent barriers. With this arrangement the barriers 10 are placed with the side margins of their bases 12 closely adjacent. The resulting barrier stack provides a concentrated mass able to absorb very high impact forces and prevent even large vehicles from passing through the barrier stack.

In addition to the described different barriers and different orientations to alter the character and degree of kinetic energy absorption, further adjustments in kinetic energy absorption are possible by filling the successive barriers 10 with successively greater quantities of water, the nearest barrier 10 being filled with less water and the last barrier 10 being completely filled. Many variations are possible, as will be apparent.

The construction of the barrier 10 suits it for highway use, but it also is suited for use in defining a vehicle race course. As compared with barriers of the prior art, the barriers 10 are relatively inexpensive, easily transportable in their unfilled state, quickly connectable in a variety of arrangements, as above described, and fillable with water to various degrees. Disassembly and movement of the barriers to other sites is easy, the drain fittings 28 being opened to empty the barriers prior to their removal.

Figure 18:
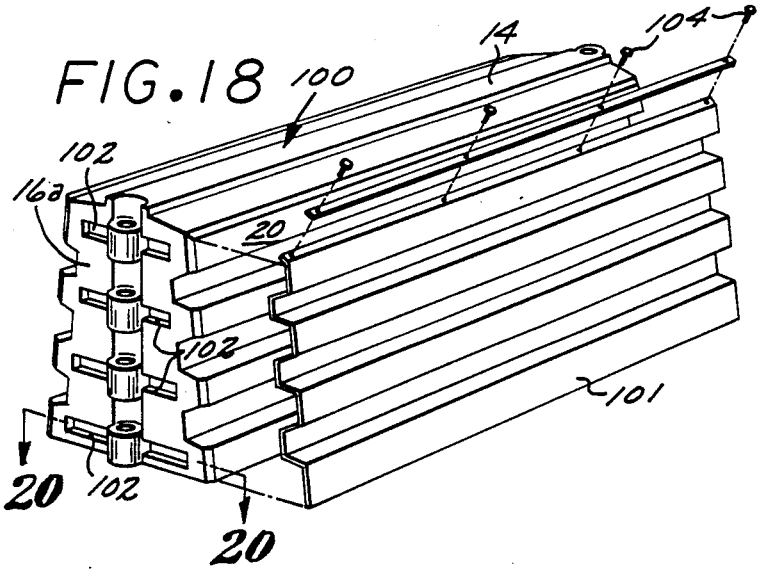
FIG. 18 is another embodiment of the barrier of FIG. 1, but provided with an overlying thin sheet metal covering to resist tearing of a barrier made of plastic material.

FIG. 18 illustrates yet another embodiment 100, the barrier 100 being identical in substantially every respect to the barrier 10 of FIG. 1, except that the end wall 16*a* is modified to provide improved resistance to bending under vehicle impact and thereby reduce consequent loading of the knuckles or protuberances 36 by the pin 42 (not shown in FIG. 18). Such improved resistance to bending is provided by integrally molding on opposite sides of each protuberance 36 a rectangularly shaped recess or box section 102 whose walls resist such bending. The number of protuberances is increased to four in the barrier 100 to better distribute the forces imparted to the end wall 16*a* by the action of the pin 42 (not shown) against the protuberances 36.

FIG. 18 also illustrates use of a thin side sheet or shield 101 of metal or tear resistant rubber or the like to protect the barrier side wall 20 from gouging and tearing by the action of an impacting vehicle. The shield 101 is configured to complementally fit the configuration of the barrier side wall 20. The side shield 101 is supported in position by any suitable means, such as by a plurality of self-tapping screws 104 disposed through an elongated bar 106 overlying the upper, inwardly formed margin of the shield 101. The screws 104 self-tap into the barrier 100.

Figure 19:
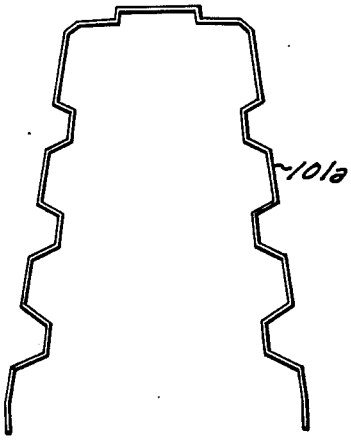
FIG. 19 is an end elevational view of a protective cover like that of FIG. 18, but adapted to overlie both sides of the barrier.
Figure 20:
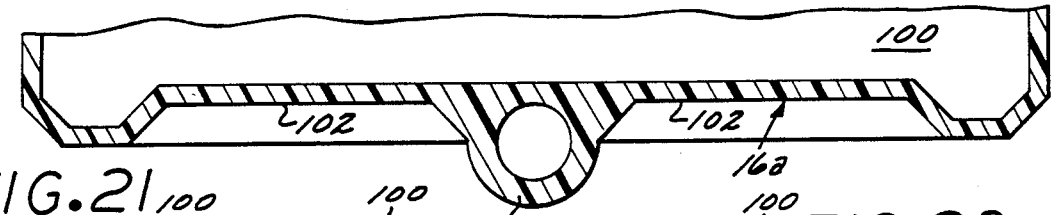
FIG. 20 is an enlarged view taken along the line 20—20 of FIG. 18.

FIG. 19 illustrates another form of side shield 101*a* similar to the shield 101, except that the shield 101*a* is an integral or one piece shield to overlie the barrier top 14 and both side walls 20.

Figure 21:
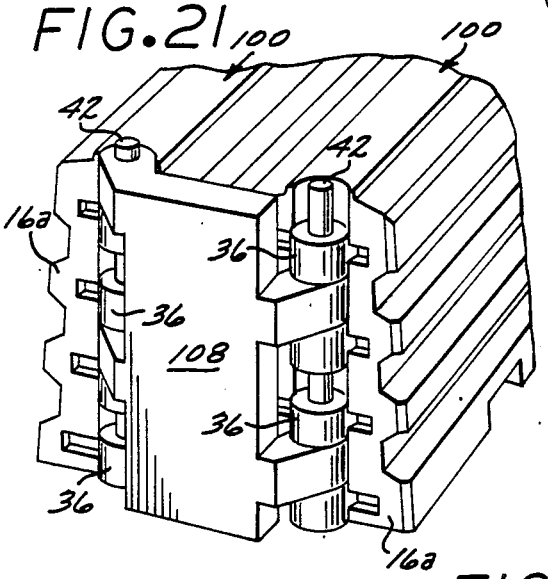
FIG. 21 is an end perspective view of a pair of barriers like that of FIG. 1, and coupled together for common movement by a special end fitting or coupling.

Referring now to FIG. 21, an end coupler 108 is illustrated which is similar in function to the couplers 52 illustrated in FIG. 7. The coupler 108 includes at its opposite margins complemental protuberances and recesses for mating with the protuberances and recesses in the end wall 16*a* of side abutting barriers 100. A similar end coupler 108 is located at the opposite ends of the barriers 100 so that the end couplers 108 connect together the adjacent barriers 100 as an integral unit to resist impact forces beyond the capability of a single barrier 100.

Figure 22:
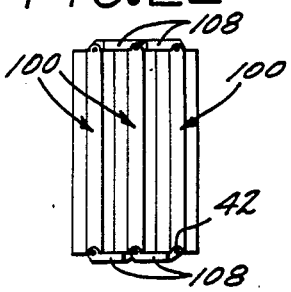
FIG. 22 is a top plan view schematically illustrating end connection of three barriers by the end fittings of FIG. 21.

FIG. 22 illustrates a schematic coupling of three barriers 100, it being apparent that as many barriers 100 can be coupled together as needed for the particular application.

Figure 23:
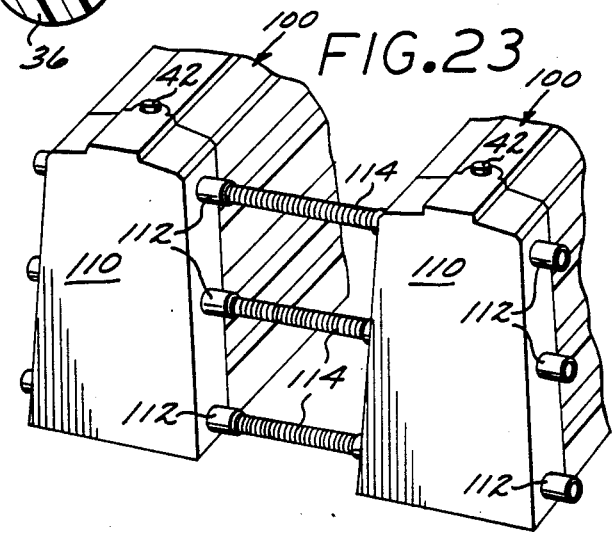
FIG. 23 is a view similar to FIG. 21, but illustrating a pair of end couplings spaced apart by biasing means.
Figure 24:
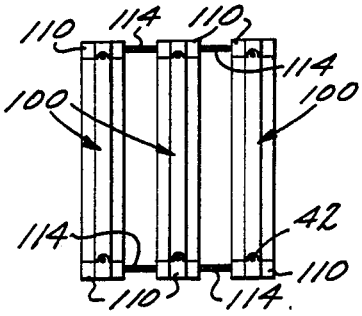
FIG. 24 is a view similar to FIG. 22, but illustrating the end fittings or couplings shown in FIG. 23.

FIGS. 23 and 24 illustrate another form of end coupler 110. A pair of such couplers 110 are shown mounted to the ends of a pair of laterally spaced apart barriers 100. The couplers 110 are secured in position by the pins 42 which pass through the protuberances 36 (not shown), the pins 42 also passing through suitable openings in the couplers 110. In addition, each coupler 110 includes three transverse openings which receive a corresponding plurality of transverse tubes 112. The tubes 112 of each coupler 110 are transversely aligned, and three compression springs 114 are disposed between the confronting tubes 112 at each end of the pair of couplers. Three rods (not shown) are disposed through the tubes 112 and the springs 114 at each end. With this arrangement, a plurality of laterally spaced apart couplers 110 are adapted to serially absorb and pass on the impact forces developed when the outermost coupler 110 is struck by a vehicle, the springs 114 compressing as this occurs.

Figure 25:
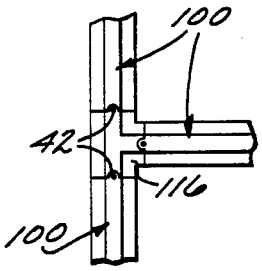
FIG. 25 is a schematic top plan view illustrating a form of T-connector adapted to couple together a pair of longitudinally oriented barriers with a transversely oriented barrier.

FIG. 25 illustrates another form of fitting or T-coupler 116 adapted to be connected to three barriers 100 by three pins 42 so that one transverse barrier 100 can be joined at right angles to a string of longitudinally arranged barriers 100. Such an arrangement could be used to more strongly constrain the transverse barrier 100 against movement upon vehicle impact, or it could be used to define right angular paths for pedestrian traffic.

Figure 26:
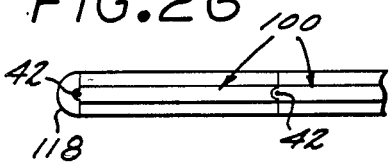
FIG. 26 is a schematic plan view of a plurality of end connected barriers, the end one of which is provided with a protective end cap for absorbing the force of an end impacting vehicle, for example.

The barrier of the present invention is adapted to incorporate various improvements and modifications for a variety of special applications. In FIG. 26, a pair of barriers 100 connected in end-to-end relationship by pins 42 are provided with a hemispherical end cap 118 connected by a pin 42 to the end one of the barriers 100. The end cap is adapted to deflect a vehicle impacting against the end of the string of barriers 100 and absorb a portion of the impact forces.

Figure 27:
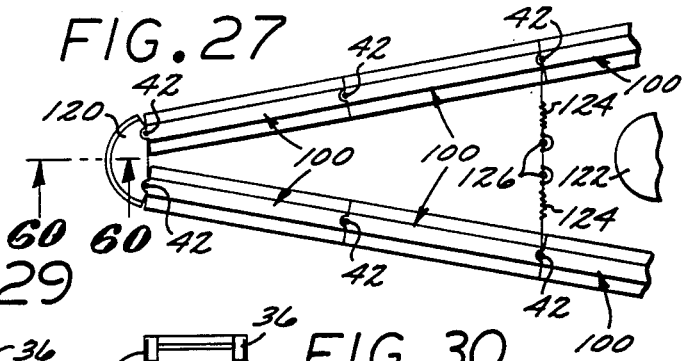
FIG. 27 is a view similar to FIG. 26, but employing a protective end cap attached to the ends of a pair of divergent strings of end connected barriers.

FIG. 27 shows an arrangement similar to that of FIG. 26, but two pairs of end connected barriers 100 are employed, the two strings converging and being joined together by a protective end coupler or end cap 120 connected to the adjacent barriers 100 by pins 42. The V-shape barrier assembly is disposed in advance or ahead of an object 122, such as a highway lighting standard, bridge abutment, or the like. A pair of tension springs 124 are connected at their outer ends to a pair of the pins 42 of the oppositely located strings of barriers 100. The inner ends of the springs 124 are fixed to rods 126 which are fixed or otherwise anchored to the underlying highway pavement. When a vehicle impacts against the end cap 120, the V-shape barrier assembly will be driven toward the object 122, extending the springs 124. Thus, impact energy is absorbed by the resistance of the barriers 100 to sliding movement over the pavement, as well as by energy absorption upon elongation of the springs 124.

Figure 28:
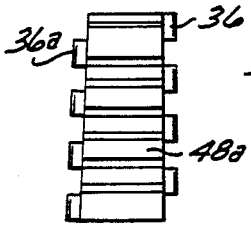
FIGS. 28, 29 and 30 are end elevational views of different end connectors for connecting together barriers to accommodate a slope of a supporting surface, or to enable a reversal of the lateral orientation of the barriers.
Figure 29:
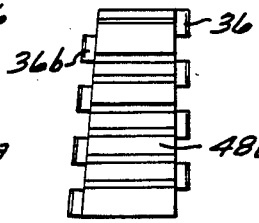
Figure 30:
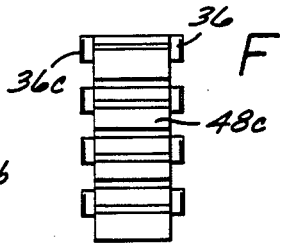

FIGS. 28 through 30 show different end connectors 48*a*, 48*b* and 48*c*. They are similar to the end connectors of FIG. 5, except that the protuberances 36 are oriented so that they will dispose the barrier to which they are connected at an angle of approximately two and a half degrees to the supporting surface for the barrier. The protuberances 36*b* are similarly arranged, but at a greater angle, such as approximately five degrees. Differences in terrain elevation are thereby accommodated. The protuberances 36*c* of FIG. 30 are substantially the same on both sides, rather than complemental, as was the case in FIGS. 28 and 29. With the arrangement of FIG. 30, the direction of orientation or curvature of the assembled barriers can be reversed, compared to the direction shown in FIG. 5, so as to form an "S" configuration.

Figure 31:
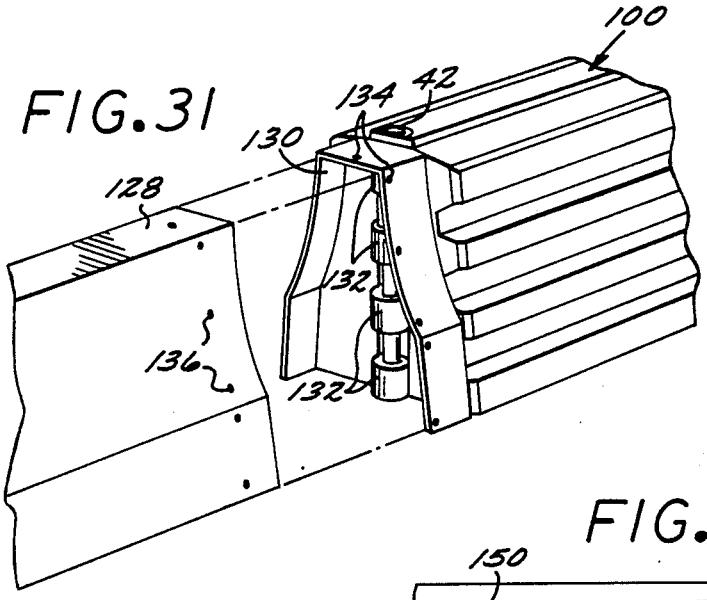
FIG. 31 is a perspective view of a conventional concrete median barrier and a barrier of the present invention which includes an attachment connector for end coupling of the two, the components being shown in exploded relationship for clarity.

FIG. 31 is illustrative of the means by which a barrier 100 can be end connected to a typical concrete median barrier 128.

An attachment connector 130 having a configuration approximating that of the configuration of the concrete barrier 128 includes a back wall which incorporates a plurality of hinge knuckles 132 adapted to receive a pin 42, which also passes through a suitable opening in the top of the connector 130.

The barrier 100 and the end connector 130 are than longitudinally moved until the connector 130 overlies the end of the concrete barrier 128. In this position suitable openings 134 in the connector are aligned with lead anchors 136 located in suitable openings provided in the concrete barrier 128. Fasteners (not shown) can then be used to secure the barrier 100 in position adjacent the concrete barrier 128.

Figure 32:
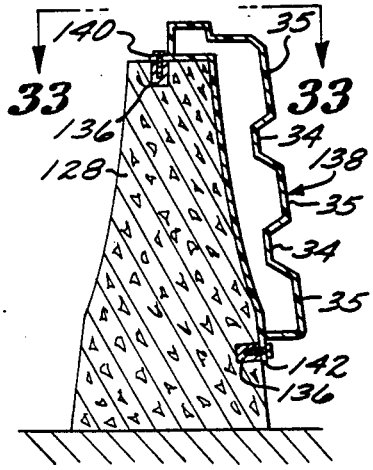
FIG. 32 is a transverse cross-sectional view of a conventional concrete median barrier provided with another embodiment of the present barrier, this embodiment constituting a form of half section to overlie one side of the concrete barrier.
Figure 33:
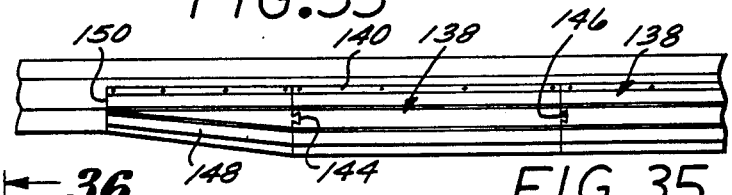
FIG. 33 is an enlarged view taken along the line 33—33 of FIG. 32.

FIGS. 32 and 33 illustrate a half barrier 138 having the channels 34 and ribs 35 of the barrier 10 of FIG. 1, but only constituting a fillable outer shell for a concrete barrier 128. The half barrier 138 includes upper and lower flanges 140 and 142 adapted to be connected to the top and base of the concrete barrier 128 by suitable fasteners disposed into lead anchors 136.

The half barrier 138 is closed at its opposite ends so that the half barrier 138 can hold water or the like. Since the half barriers 138 are supported in position by the concrete barrier 128, their abutting ends can be secured together by dovetail projections 144 or the like on one end of a barrier 100 which fit into dovetail recesses 146 in the end of the adjacent half barrier 138. Preferably the end one of the half barriers 138, designated by the numeral 148, is convergent, as seen in FIG. 33, terminating in an end 150 approximating the configuration of the adjacent portion of the concrete barrier 128. This arrangement permits deflection and gradual absorption of the impacting force of a vehicle striking the end 150 of the half barrier 148.

Figure 34:
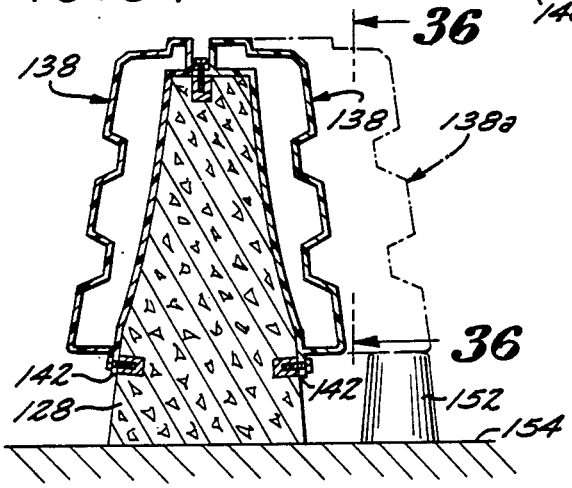
FIG. 34 is a view similar to FIG. 32, but illustrating a pair of the half barriers of the embodiment of FIG. 32, and overlying both sides of the concrete barrier.

FIGS. 34 and 36 are illustrative of the use of two half barriers 138, one located on either side of the concrete median 128. In addition, if the size of the half barrier 138 is to be made greater, such as is indicated in phantom outline at 138*a* in FIG. 34, the base of the half barrier 138*a* can conveniently be supported by a pedestal 152 underlying the half barrier 138*a* and resting upon the highway pavement 154.

Figure 35:
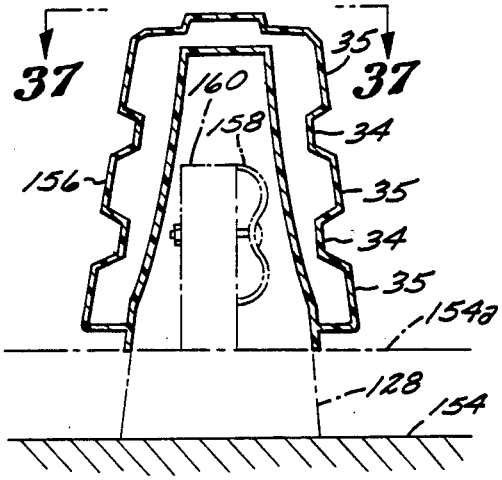
FIG. 35 is a top plan view of yet another embodiment of the barrier of the present invention, the barriers of FIG. 35 being characterized by a dovetailed end connection and specially tapered end barrier.

FIGS. 35 and 37 illustrate a similar arrangement, this time the two half barriers 138 of FIGS. 34 and 36 being replaced by a unitary shell barrier 156 of inverted U-shape which is fluid fillable and which rests of its own weight upon the top and sides of a concrete barrier 128, shown in phantom outline, without any necessity for fasteners. In addition, the shell barrier 156 is also adapted to overlie a typical elongated guard rail 158 supported upon a series of posts 160, as shown in phantom outline. In this application, the pavement would be located as shown at 154*a* in phantom outline, and the shell barrier 156 would rest of its own weight upon the pavement 154*a*. Thus, the barrier 156 is uniquely adapted for use with either the conventional concrete barrier 128 or the conventional, widely used guard rail 158.

FIGS. 39 and 40 show a variation on the arrangement of FIGS. 23 and 24. In the embodiment of FIGS. 39 and 40, the end couplers 110*a* not only include hinge protuberances and recesses on one side, as in the case of the end couplers 110, but include them on both sides so that the pins 42 can be used to end connect adjacent barriers 100. Further, as best seen in FIG. 40, the transverse rods in the arrangement of FIGS. 23 and 24, seen in FIGS. 39 and 40 as rods 160, extend through the springs 114 as before, but the tubes 112 are eliminated and circular recesses or seats 162 are provided in the sides of the end couplers 110*a* to seat the adjacent ends of the springs 114.

FIG. 41 illustrates a modified form of barrier 100*a* which is substantially identical to the barrier 100 except for the inclusion in the barrier 100*a* of an integral, vertically oriented and longitudinally extending central core 164. The core 164 is upwardly open so that it can be filled with concrete or the like, if it is desired to add more mass, or it can be filled with earth for plantings to suit the barrier to decorative applications.

FIG. 43 is a variation on the embodiment of FIG. 27, and is characterized by an end cap 120 attached to the adjacent ends of strings of end connected barriers 100 arranged in divergent, V-shape configuration, the adjacent ends of each string of barriers 100 being connected together by a coupler 116 like that illustrated in FIG. 25. A specially sized and configured barrier 166 is pin connected to the confronting T-shape couplers 116.

FIG. 44 is illustrative of yet another arrangement of previously described components. In this case the barriers 100 are end connected in two parallel strings of barriers 100. A transverse string of barriers 100 is connected to the first pair of strings by a pair of the T-shape couplers 116. Such an arrangement could be utilized as a barrier for runaway trucks traveling in the direction of the arrow 168. The truck impacting the transverse string of barriers 100 not only must deform and move the transverse barriers 100, but must also progressively drag the parallel strings of barriers 100, whereby a very great impact force can be progressively absorbed and dissipated.

FIG. 45 illustrates a protective bar 169 which could be used as a sign support or in place of the protective side shield 102 of FIG. 18, the bar 169 including lateral arms which can be pin connected to the adjacent barrier 100 by the usual pins 42 (not shown).

FIG. 46 shows a form of dolly 170 which can be used to underlie a barrier 100. The barrier is supported upon the cross members 172 of the dolly for rolling back and forth upon the dolly wheels 174. As seen in FIG. 47, this arrangement can be used to provide a form of movable gate, the movable barrier 100 being moved between open and closed positions to open or close off a protected area.

FIG. 49 illustrates how a plurality of extension barriers 176 can be end connected and stacked on top of the basic barriers 100 to provide a relatively high composite barrier especially suited to intercept flying debris or like objects, or to block unwanted viewers or traffic sounds or the like. The extension barriers 176 are essentially identical in every respect to the previously described barriers 100, except for their generally vertically oriented side configuration. They may or may not be filled with fluid, as desired.

FIG. 48 illustrates an enlarged half barrier 178 similar to the enlarged half barrier 138 of FIG. 34. It is mounted to a concrete barrier 128 by fasteners 180 and 182 passing into lead anchors 136 in the barrier 128. The lower portion of the half barrier 178 includes an integral, molded-in passage 184 to permit installation of the fastener 182. The portion of the barrier 178 adjacent the outer end of the passage 184 slopes downwardly and inwardly to form a support portion 186 which rests against the base of the barrier 128 to transmit the weight of the filled half barrier 178, thus eliminating any need for the pedestal 152 of the embodiment of FIG. 34.

The side configuration of the barrier can be varied to suit special situations. For example, in FIG. 55, a barrier 188 is provided which more closely spaced channels 34*a* and protuberances 35*a*, with the plane within which the outer faces of the ribs 35*a* lies being generally inwardly and upwardly directed, and intercepting a laterally projecting, overhanging capture portion 190. The portion 190 overlies all of the subjacent ribs 35*a* and forms an overhang which aids in preventing vaulting or leaping of the barrier 188 by a vehicle tire. The capture portion 190 is similar to the upwardly located rib 35 illustrated in FIG. 52 for constraining upward movement of the vehicle tire 66.

Figure 57:
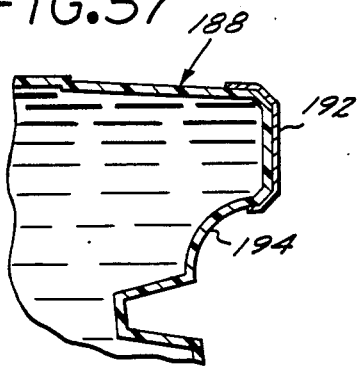
FIGS. 57–60 are partial transverse cross sectional views of yet other embodiments of the present barrier, each illustrating a different barrier configuration.

FIG. 57 illustrates a barrier 188 provided with a protective strip 192 of metal, rubber or fiberglass to protect the plastic material of the barrier 188 from tearing, gouging or similar damage by an impacting vehicle.

Figure 58:
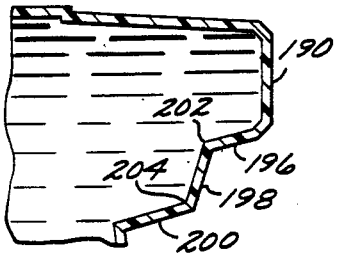

The connecting portion 194 extending between the mouth of the upper recess 34*a* and the capture portion 190 of the barrier 188 is generally curvilinear. In contrast, the barrier of FIG. 58 includes a connecting portion characterized by a generally inwardly directed face 196 merging with a generally downwardly directed face 198, which merges with a generally inwardly directed face 200, thereby forming longitudinally extending bends or seams 202 and 204. These form a box section more resistant to bending, as compared with the curvilinear connecting portion 194 of FIGS. 55 and 57.

Figure 55:
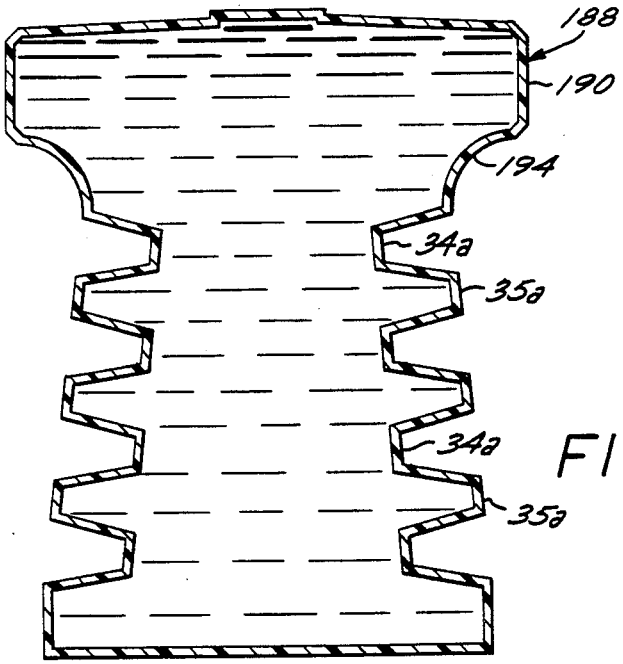
FIG. 55 is a transverse cross sectional view of a further embodiment of the present barrier, with a different side wall and upper portion configuration.
Figure 59:
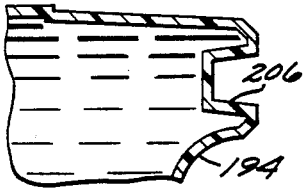

FIG. 59 illustrates a barrier 188 like that of FIG. 55, except that the box section is defined by configuring the outer face of the upper portion 190 to form an inwardly directed channel 206 which is resistant to deformation or bending, and thereby is better able to maintain its shape and constrain a vehicle tire against upward travel.

Figure 56:
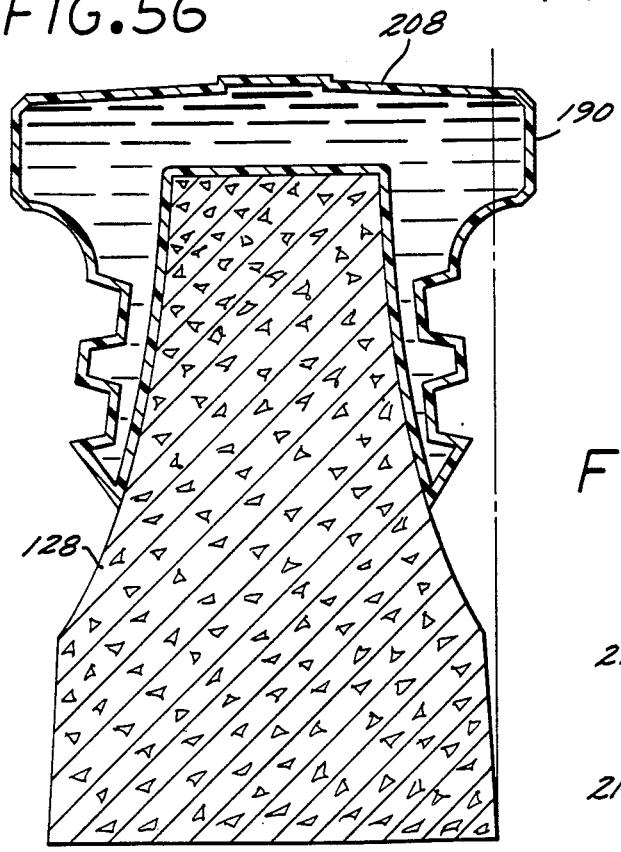
FIG. 56 is a view similar to FIG. 35, but illustrating a different barrier configuration.

FIG. 56 illustrates a barrier 208 having side configurations like that of the barrier 188 of FIG. 55, except that it is adapted to rest of its own weight on a concrete barrier 128 in a manner like the shell barrier 156 of FIG. 35.

Figure 60:
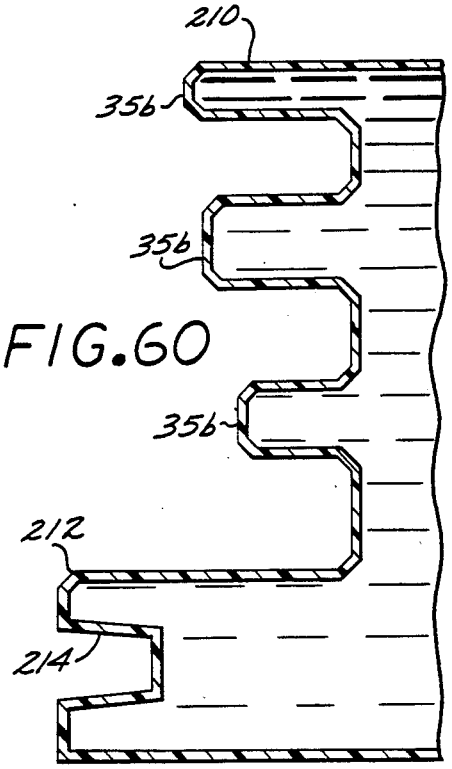

FIG. 60 is another embodiment of the barrier of the present invention, in this case a barrier particularly adapted to absorb the impact of a motor vehicle striking it at substantially a right angle. At this angle a vehicle barrier is prone to tip over, especially if the vehicle climbs up or tends to vault upwardly and over the barrier. To prevent this the barrier 210 is characterized by generally horizontally directed portions defining superposed ribs **35*b* projecting to a lesser and lesser degree from top to bottom. In addition, a bottom portion 212 of the barrier 210 extends outwardly considerably beyond the ribs 35*b* to provide a very wide and stable base, the outer face of the bottom portion 212 including a box shape or channel 214** for improved resistance to bending.

The configuration of the barrier 210 is designed such that when the barrier 210 is struck at approximately a 90 degree angle by the usual passenger vehicle, the bumper goes over the lowermost portion 212 and impacts and compresses the lowermost, shortest rib **35*b*. The vehicle hood will go over the lowermost rib 35*b*, will impact against and compress the next highest rib 35*b*, and will slide under the topmost rib 35*b*. The topmost rib 35*b* thus acts like an overhang to trap the hood and thereby prevent the vehicle from vaulting or leaping the barrier 210**.

The barrier 210 is prevented from tipping over away from the vehicle by reason of the "hooking" engagement of the portion 212 with the bottom of the vehicle bumper.

Energy absorption is provided initially by compression of the lowermost rib **35*b* by the bumper, the next higher rib 35*b* by the hood, and the bottom portion 212** by the vehicle tires. As vehicle movement proceeds, the entire barrier aids in absorbing the impact energy.

Figure 9:
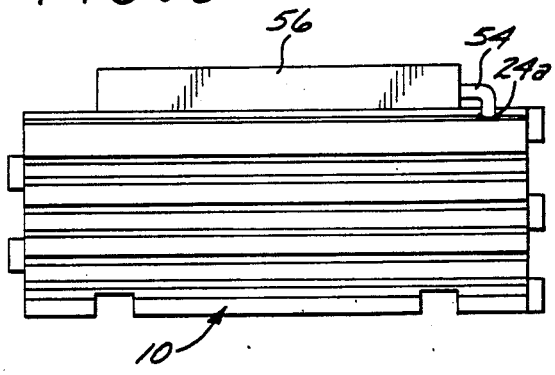
FIG. 9 is a generally diagrammatic side elevational view, on a reduced scale, of a barrier fitted with an overflow compartment or diaphragm.

FIGS. 9 and 10 diagramatically illustrate filling and emptying arrangements for the barrier 10 of FIG. 1.

FIG. 9 illustrates a fill cap **24*a* associated with a conduit 54 extending from the bottom of the barrier interior chamber to a bladder or overflow container 56 located on top of the barrier. The container 56 is similar to the previously described bag 92, except that it is normally always externally located. On impact, water forced out of the barrier fill opening flows into the container 56, from which it can run back down by gravity into the barrier 10** after the impacting vehicle moves away.

FIG. 10 illustrates yet another barrier modification, in this case a form of filler cap **24*b* associated with a pressure line 58 extending from the interior chamber of the barrier 10 to a pressurized gas bottle 60. The cap 24*b* is also associated with a conduit 62 which extends to the bottom of the interior chamber of the barrier 10, and terminates in a usual fire hose 64. In the event an emergency supply of water is necessary for fire fighting, for example, the gas bottle 60 can be actuated to pressurize the barrier interior and force water out of the fire hose 64. The contained material can be any fluid for the type of fire or other emergency anticipated. Moreover, the fire hose 64** could also be used as a fogging device to provide a protective water spray around the driver of a crashed vehicle.

From the foregoing it will be apparent that the present barrier 10 is characterized by great versatility and, most importantly, constitutes a portable, low cost, easily transportable and effective barrier for dissipating the kinetic energy developed upon impact by a moving vehicle. Its unique side wall configuration is effective to reduce the tendency of a vehicle tire to climb up the side wall and vault the vehicle over the barrier. When the side walls of these barriers are struck at a shallow angle, they tend to resilently yield and hold the vehicle against the wall while speed is lost by "scrubbing" of the tire against the wall, rather than the vehicle ricocheting off and into adjacent traffic or into restricted areas.

The barrier of the present invention, in all of its embodiments, is best utilized when the principle of progressive absorption of impact energy is observed. If several of the barriers are arranged, end-to-end, or stacked side-by-side, or spaced apart in side-by-side relation, the first of the barriers struck by the impacting vehicle should be made capable of deforming or yieldably sliding relatively easily. As previously explained, this can be done by only partially filling it with liquid or other fluent material, or it could be done by not projecting the pins 42 into the pavement or other supporting surface.

The barrier or barriers next encountered by the vehicle preferably are filled with liquid to a greater extent, and perhaps the pins 42 projected into the pavement or into receptacles in the pavement. The pins could be made of a cross-sectional thickness and of a material adapted to shear relatively easily. The next barrier or barriers along the vehicle path would be even more completely filled, and perhaps employ pins 42 having an even greater resistance to shearing. In this way the passengers in vehicles striking the barrier arrangement would not be subjected to high deceleration forces. The gradual deceleration provided by the barrier arrays brings such forces into a managable range so that vehicle occupants can survive impacts at relatively high vehicle speeds.

An important element in such progressive vehicle decelerations is the yieldability of the barrier structure, and the progressive scrubbing and slowing of the vehicle tire or tires as they push against upper overhanging portions and forwardly located portions dynamically formed in the flexible barrier side walls by the impacting vehicle as it moves along the barrier. The deformed portions present an obstacle constraining the vehicle against vaulting the barrier, and the low coefficient of friction of the barrier material, as well as the presence of traction spoiler channels, reduces the ability of the vehicle tire to develop traction and climb the barrier.

Various modifications and changes may be made with regard to the foregoing detailed description without departing from the spirit of the invention.

What is claimed is:

1. An energy absorbing barrier for dissipating kinetic energy upon impact by a moving vehicle, said barrier comprising:

an elongate container having walls, including a pair of longitudinally directed side walls, defining an interior chamber having a fill opening for admitting fluent material into said chamber, said container being configured and constructed of a material having a rigidity sufficient for said container to retain its shape both when said chamber is empty and when it is filled with said fluent material whereby said barrier is adapted to serve both as a self-supporting lightweight barrier and as a heavier barrier, respectively, said material further having a resilience sufficient to deform upon impact by a vehicle and recover its shape after said impact whereby an impacted one of said longitudinally directed side walls is adapted to progressively deform along its length as the impacting vehicle travels along said length, thereby progressively slowing said vehicle.

2. An energy absorbing barrier according to claim 1 wherein said side walls are relatively high compared to the height of the usual passenger vehicle tire whereby an undeformed portion of a side wall tends to remain above said tire upon deformation of said side wall by said tire.

3. An energy absorbing barrier according to claim 1 and including flexible cable means extending between and anchored to said side walls to resist outward bulging of said side walls.

4. An energy absorbing barrier according to claim 1 wherein said container includes an integral internal web extending between said side walls to resist outward bulging of said side walls.

5. An energy absorbing barrier according to claim 1 wherein said side wall is characterized by a concave configuration when said container is empty whereby said side wall tends not to outwardly bulge upon filling of said container with said fluent material.

6. An energy absorbing barrier according to claim 1 wherein said container includes an upwardly opening recess; a flexible and resilient bag in said recess; and a conduit opening from said container into said bag whereby, upon vehicle impact against said side walls, said fluent material is adapted to flow into said bag and force the main portion of said bag out of said recess for filling with said fluent material.

7. An energy absorbing barrier according to claim 1 wherein said container includes means defining an integral, upwardly opening recess within said container for receiving concrete, earth or the like.

8. An energy absorbing barrier according to claim 1 and including a median attachment fitting having vertically aligned and spaced apart protuberances and intervening recesses; said container including an end wall having end fittings comprising vertically aligned and spaced apart protuberances and recesses for complementally receiving said protuberances and recesses of said median attachment fitting for an end coupling said barrier to a highway median.

9. An energy absorbing barrier according to claim 1 and including a plurality of said containers arranged in a stacked, side-by-side relation.

10. An energy absorbing barrier according to claim 1 and including a pair of said containers arranged in a spaced apart, side-by-side relation; and including bias means extending therebetween.

11. An energy absorbing barrier according to claim 1 wherein said material is a plastic material characterized by a relatively low coefficient of friction.

12. An energy absorbing barrier according to claim 1 wherein said material is a plastic material characterized by a relatively low coefficient of friction, and wherein at least one of said side walls includes longitudinally extending, vertically spaced apart traction spoiler channels operative to reduce the traction between said one of said side walls and the tires of an impacting vehicle whereby said vehicle is slowed and constrained from climbing and vaulting over said barrier.

13. An energy absorbing barrier according to claim 1 wherein at least one of said side walls is relatively high compared to the height of the usual passenger vehicle tire whereby a portion of said one of said side walls tends to overlie said tire upon deformation of said one of said side walls by said tire.

14. An energy absorbing barrier according to claim 1 wherein at least one of said side walls includes longitudinally extending, vertically spaced apart traction spoiler channels operative to reduce the traction between said of said side walls and the tires of an impacting vehicle whereby vehicle is slowed and constrained from climbing and vaulting over said barrier.

15. An energy absorbing barrier according to claim 14 and wherein said container includes a base portion located below and extending beyond said traction spoiler channels, said base portion being adapted to pass beneath the bumper of a vehicle striking said side wall.

16. An energy absorbing barrier according to claim 14 and including a pair of said containers arranged in a divergent V-shape.

17. An energy absorbing barrier according to claim 1 wherein said container includes a pair of end walls having end fittings for end coupling said barrier to a like barrier.

18. An energy absorbing barrier according to claim 17 wherein said fittings are disposed at an angle relative to the said container whereby a plurality of containers may be interconnected over an uneven supporting surface.

19. An energy absorbing barrier according to claim 17 wherein said end fittings comprise vertically aligned and spaced apart protuberances and intervening recesses for receiving complemental protuberances of a like barrier.

20. An energy absorbing barrier according to claim 19 wherein said protuberances include vertically aligned openings; and including elongate elements disposed through said openings for constraining said barrier against separation from adjacent interengaged like barriers.

21. An energy absorbing barrier according to claim 20 wherein said elements project above said container; and including fencing material extending between and carried by said elements.

22. An energy absorbing barrier according to claim 20 wherein said elements project above said containers; and including cables extending between and carried by said elements.

23. An energy absorbing barrier according to claim 20; and including tension means coupled between adjacent ones of said elements for absorbing a portion of the impact forces developed by a vehicle striking said side wall.

24. An energy absorbing barrier according to claim 20 wherein said end walls include integral recessed box sections adjacent opposite sides of each of said protuberances for resistance of said end walls to bending upon development of said impact forces.

25. An energy absorbing barrier according to claim 20 and including an extension barrier disposed on top of said elongate container and having portions having vertically aligned openings aligned with said openings in said protuberances, and said elongate elements are diposed through the openings of said portions and said protuberances to support said extension barrier in position.

26. An energy absorbing barrier for dissipating kinetic energy upon impact by a moving vehicle, said barrier comprising:

an elongate container having a base, a top, a pair of end walls and a pair of side walls defining an interior chamber, said end walls including end fittings adapted for end coupling said barrier to one or more like barriers, said side walls being made of a material having a relatively low coefficient of friction and of a resilience sufficient to recover its original shape after being struck by a vehicle, said side walls including longitudinally extending, vertically spaced apart traction spoiler channels operative to reduce traction between said barrier and the tires of an impacting vehicle as said tires engage said barrier whereby said relatively low coefficient of friction, said resilience, and said loss of traction slow and constrain said vehicle from climbing and vaulting over said barrier, said container having a fill opening for admitting fluent material into said chamber,said barrier being sufficiently rigid that said barrier substantially retains its shape both when said chamber is empty and when it is filled with said fluent material whereby said barrier is adapted to serve as a free standing lightweight barrier and as a heavier vehicle barrier, respectively.

27. An energy absorbing barrier according to claim 26 and including an overflow receptacle located externally of said container; and conduit means extending into said container and coupled to said receptacle for conveying liquid to said receptacle from said container upon impact of said container by a moving vehicle.

28. An energy absorbing barrier according to claim 26 and including pressure means coupled to said container and operative to pressurize said container; and conduit means extending into said container for discharging liquid from said container upon operation of said pressure means.

29. An energy absorbing barrier according to claim 28 wherein said conduit means includes a fire hose for utilizing said liquid in fighting fires.

30. An energy absorbing barrier according to claim 26 wherein said end fittings are adapted to receive vertically oriented, elongate elements adapted to be driven into the ground or other supporting surface for said barrier.

31. An energy absorbing barrier according to claim 30 wherein said elongate elements are hollow, and including elongate rods received within said elements to define upright standards for fencing, flags or the like.

32. An energy absorbing barrier according to claim 26 wherein said base includes fork lift openings whereby said barrier can be lifted by a fork lift.

33. An energy absorbing barrier according to claim 26 wherein said end fittings comprise vertically aligned and spaced apart protuberances and intervening recesses for receiving complemental protuberances of a like barrier.

34. An energy absorbing barrier according to claim 33 wherein said protuberances of one of said end walls are longitudinally aligned with said recesses of the other of said end walls, and said recesses of said one of said end walls are longitudinally aligned with said protuberances of said other of said end walls whereby the end walls of said barrier are adapted to interengage with the end walls of like barriers adjacent said end walls.

35. An energy absorbing barrier according to claim 34 wherein said protuberances include vertically aligned openings for receiving elongate elements to constrain said barrier against separation from adjacent interengaged like barriers.

36. An energy absorbing barrier according to claim 35 wherein each of said recesses is greater in height than the height of each of said protuberances thereby to provide vertical clearances, and wherein each of said vertically aligned openings is greater in diameter than the diameter of each of said elongate elements thereby to provide lateral clearances, whereby said vertical and lateral clearances enable interengaged barriers to be located at difference heights to accommodate gradual changes in terrain elevation.

37. An energy absorbing barrier according to claim 26 and including a flexible cable extending longitudinally along each of said side walls and anchored at its extremities to end portions of said container.

38. An energy absorbing barrier according to claim 26 wherein said fluent material is a liquid.

39. An energy absorbing barrier according to claim 26 wherein said material is resiliently deformable whereby a traveling wave of said material is formable in advance of an impacting vehicle tire thereby to tend to slow and frictionally disable said tire from said climbing.

40. An energy absorbing barrier according to claim 39 wherein said material is cross-linked, high density polyethylene.

41. An energy absorbing barrier according to claim 39 wherein said side wall is planar and slopes upwardly and inwardly.

42. An energy absorbing barrier according to claim 39 and including a complemental shell overlying said side walls for protecting said side walls against tearing.

43. An energy absorbing barrier according to claim 39 wherein said container is configured to overlie at least one side of a highway median barrier, said container being adapted for fixed attachment to said median barrier.

44. An energy absorbing barrier according to claim 39 wherein said container is configured to define a contral space for receiving a highway median barrier, with said side walls disposed on opposite sides of said highway median barrier.

45. An energy absorbing barrier for dissipating kinetic energy upon impact by a moving vehicle, said barrier comprising:

a plurality of containers, each having walls, including a pair of longitudinally directed side walls, defining an interior chamber having a fill opening for admitting fluent material into said chamber, said container being configured and constructed of a material having a rigidity sufficient for said container to retain its shape both when said chamber is empty and when it is filled with said fluent material whereby said barrier is adapted to serve both as a self-supporting lightweight barrier and as a heavier barrier, respectively, each said container carrying end means coupling said containers together to define a container string having substantially longitudinally directed continuous side wall surfaces, said material further having a resilience sufficient to deform upon impact by a vehicle and recover its shape after said impact whereby ah impacted one of said substantially continuous side wall surfaces is adapted to progressively deform along the length of said container string as the impacting vehicle travels along said length, thereby progressively slowing said vehicle.

46. An energy absorbing barrier for dissipating kinetic energy upon impact by a moving vehicle, said barrier comprising:

a plurality of containers, each having a base, a top, a pair of end walls and a pair of side walls defining an interior chamber, said end walls including end fittings for end coupling said containers to like containers adjacent its end walls, respectively, to define a container string, said side walls being made of a material having a relatively low coefficient of friction and a resilience sufficient to recover its original shape after being struck by a vehicle, said side walls including longitudinally extending, vertically spaced apart ribs defining vertically spaced apart traction spoiler channels operative, respectively, to resiliently deform and reduce traction between said barrier and the tires of impacting vehicle as said tires engage said barrier whereby said relatively low coefficient of friction, the rib defromation, and the reduction of said traction slow and constrain said vehicle from climbing and vaulting over said barrier, said container having a fill opening for admitting fluent material into said chamber, said side walls being configured and sufficiently rigid that said side walls substantially retain their shape both when said chamber is empty and when it is filled with said fluent material whereby said barrier is adapted to serve as a free standing lightweight pedestrian barrier and as a heavier vehicle barrier, respectively; and a plurality of vertically oriented, elongate elements disposed through said end fittings of said containers, respectively, to constrain said containers against separation.

47. An energy absorbing barrier for dissipating kinetic energy upon impact by a moving vehicle, said barrier comprising:

a plurality of containers, each having a base, a top, a pair of end walls and a pair of side walls defining an interior chamber, said end walls including end fittings for end coupling said containers to like containers adjacent its end walls, respectively, to define a container string, said side walls being made of a resilient material having a relatively low coefficient of friction and including longitudinally extending, vertically spaced apart traction spoiler, said side walls sloping inwardly and upwardly and thereby more inwardly locating successively higher ones of said traction spoiler channels so that said traction spoiler channels are adapted to be successivley encountered by the tires of an impacting vehicle, commencing with the traction spoiler channels located near said base, and thereby providing successive reductions in the area of contact between said barrier and said tires as said tires climb upwardly upon said barrier whereby said relatively low coefficient of friction and said successive reductions in the area of contact constrain said vehicle from climbing and vaulting over said barrier, said containers having a fill opening for admitting fluent material into said chamber, and said barrier being sufficiently rigid to substantially retain its shape both when said chamber is empty and when it is filled with said fleunt material whereby said barrier is adapted to serve as a free standing lightweight pedestrian barrier and as a heavier vehicle barrier, respectively; and a plurality of vertically oriented, elongate elements disposed through end fittings of said containers, respectively, to constrain said containers against separation.

48. An energy absorbing barrier for dissipating kinetic energy upon impact by a moving vehicle, said barrier comprising:

a plurality of containers, each having a base, a top, a pair of end walls and a pair of side walls defining an interior chamber, said end walls including end fittings, said side walls being made of a resilient material having a relatively low coefficient of friction and including longitudinally extending, vertically spaced apart traction spoiler channels, said side walls sloping inwardly and upwardly and thereby more inwardly locating successively higher ones of said traction spoiler channels so that said traction spoiler channels are adapted to be successively encountered by the tires of an impacting vehicle, commencing with the traction spoiler channels located near said base, and thereby providing successive reductions in the area of contact between said barrier and said tires as said tires climb upwardly upon said barrier whereby said relatively low coefficient of friction and said successive reductions in the area of contact constrain said vehicle from climbing and vaulting over said varrier, each said container having a fill opening for admitting fluent material into said chamber and each being configured and sufficiently rigid to substantially retain its shape both when said chamber is empty and when it is filled with said fluent material whereby said barrier is adapted to serve as a free standing lightweight barrier and as a heavier vehicle barrier, respectively; and a plurality of coupling means interposed between said containers, respectivley, and coupling said end fittings of said containers to define a container string.

49. An energy dissipating barrier according to claim 48, wherein opposite vertical faces of each of said coupling means define a predetermined included second angle, and wherein a pair of said coupling means is interposed between each pair of adjacent containers whereby said container string follows a zig-zag path.

50. An energy dissipating barrier according to claim 49, wherein opposite vertical faces of each of said coupling means define a predetermined included third angle, and wherein a pair of said coupling means is interposed between each pair of adjacent containers whereby said container string defines a closed block of said containers, with the edges of the container bases immediately adjacent each other.

* * * * *

UNITED STATES PATENT AND TRADEMARK OFFICE

CERTIFICATE OF CORRECTION

PATENT NO. : 4,681,302

DATED : July 21, 1987

INVENTOR(S) : Marion L. Thompson

It is certified that error appears in the above-identified patent and that said Letters Patent is hereby corrected as shown below:

Column 9, line 63, after "FIG." insert --5--;
Column 17, line 28, after "wherein" insert --each--;
Column 18, line 14, after "said" (first instance) insert --one--;
line 50, delete "containers" and insert --container--;
Column 20, line 68, delete "ah" and insert --an--;
Column 21, line 22, after "tires of" insert --an--;
line 25, delete "defromation" and insert --deformation--;
line 51, after "spoiler" insert --channels--;
Column 22, line 2, delete "containers" and insert --container--;
line 6, delete "fleunt" and insert --fluent--; and
line 37, delete "varrier" and insert --barrier--.

Signed and Sealed this

Eighth Day of December, 1987

*Attest:*

DONALD J. QUIGG

*Attesting Officer*

*Commissioner of Patents and Trademarks*